US010422511B1

(12) United States Patent
Formel et al.

(10) Patent No.: US 10,422,511 B1
(45) Date of Patent: Sep. 24, 2019

(54) COVERS FOR EMERGENCY EGRESS LIGHT FIXTURES

(71) Applicant: Cooper Technologies Company, Houston, TX (US)

(72) Inventors: Scott Peter Formel, Peachtree City, GA (US); Anthony Reale, Allen Park, MI (US); Joseph Cazeno, III, Farmington Hills, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/491,678

(22) Filed: Apr. 19, 2017

Related U.S. Application Data

(60) Provisional application No. 62/324,605, filed on Apr. 19, 2016.

(51) Int. Cl.

| | |
|---|---|
| ***F21V 15/01*** | (2006.01) |
| ***F21S 8/00*** | (2006.01) |
| ***F21S 9/02*** | (2006.01) |
| ***F21V 19/02*** | (2006.01) |
| ***F21V 17/16*** | (2006.01) |

(52) U.S. Cl.
CPC ..... *F21V 15/01* (2013.01); *F21S 8/033* (2013.01); *F21S 9/022* (2013.01); *F21V 17/16* (2013.01); *F21V 19/02* (2013.01)

(58) Field of Classification Search
CPC ..... F21V 15/01; F21V 17/16; F21V 19/02; F21S 8/033; F21S 9/022
See application file for complete search history.

(56) References Cited

U.S. PATENT DOCUMENTS

| | | | | |
|---|---|---|---|---|
| D313,669 | S | 1/1991 | Sonneman | |
| 5,645,341 | A * | 7/1997 | Liao | F21L 4/08 362/183 |
| D386,801 | S | 11/1997 | Orgovan | |
| D398,415 | S | 9/1998 | Markee | |
| D403,458 | S | 12/1998 | Walz | |
| 6,142,649 | A * | 11/2000 | Beghelli | F21S 9/022 362/259 |
| 6,371,621 | B1 * | 4/2002 | Le Bel | F21S 8/02 362/20 |
| D469,910 | S | 2/2003 | St-Pierre | |
| 7,182,487 | B1 * | 2/2007 | Pickard | F21S 9/022 174/535 |
| D540,978 | S | 4/2007 | Cormier | |
| D591,883 | S | 5/2009 | Gill | |
| D595,477 | S | 7/2009 | Loret | |
| D625,460 | S | 10/2010 | Boissevain | |
| D646,425 | S | 10/2011 | Crosby | |
| D711,040 | S | 8/2014 | Huang | |
| D735,927 | S | 8/2015 | Lee | |
| D735,928 | S | 8/2015 | Hawkins | |
| D748,238 | S | 1/2016 | Meeker | |

(Continued)

*Primary Examiner* — Anabel Ton
(74) *Attorney, Agent, or Firm* — King & Spalding LLP

(57) ABSTRACT

A lighting system can include a light fixture having a body and at least one light source, where the light fixture is coupled to a structure. The lighting system can also include a cover having at least one first fixture coupling feature, where the at least one first fixture coupling feature detachably couples to the body of the light fixture, and where the cover physically covers at least a first portion of the body of the light fixture.

19 Claims, 16 Drawing Sheets

(56) References Cited

U.S. PATENT DOCUMENTS

| | | | | |
|---|---|---|---|---|
| D757,347 | S | 5/2016 | Chen | |
| D781,481 | S | 3/2017 | Chen | |
| D784,589 | S | 4/2017 | Chen | |
| 9,630,554 | B1 * | 4/2017 | Whitfield | B60Q 7/00 |
| D796,723 | S | 9/2017 | Sonneman | |
| D796,724 | S | 9/2017 | Sonneman | |
| D797,985 | S | 9/2017 | Perkins | |
| 2005/0116667 | A1 * | 6/2005 | Mueller | E04F 13/08 315/312 |
| 2009/0185359 | A1 * | 7/2009 | Martinez | F21L 4/08 362/20 |
| 2013/0077293 | A1 * | 3/2013 | Lee | F21V 29/677 362/184 |
| 2013/0141937 | A1 * | 6/2013 | Katsuta | G02B 6/005 362/606 |
| 2013/0155723 | A1 * | 6/2013 | Coleman | G02B 6/0018 362/621 |
| 2014/0049961 | A1 * | 2/2014 | Wilcox | F21V 5/04 362/244 |

* cited by examiner

FIG. 20B
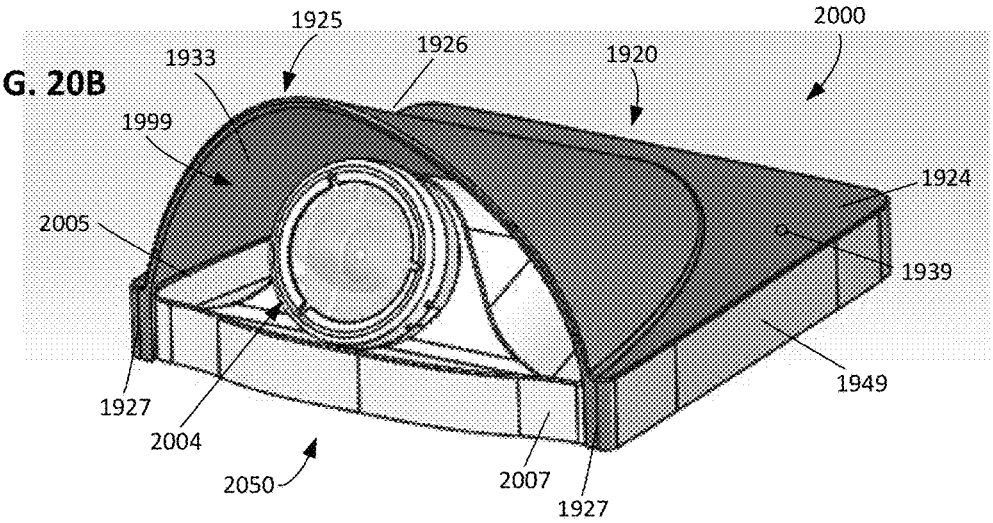
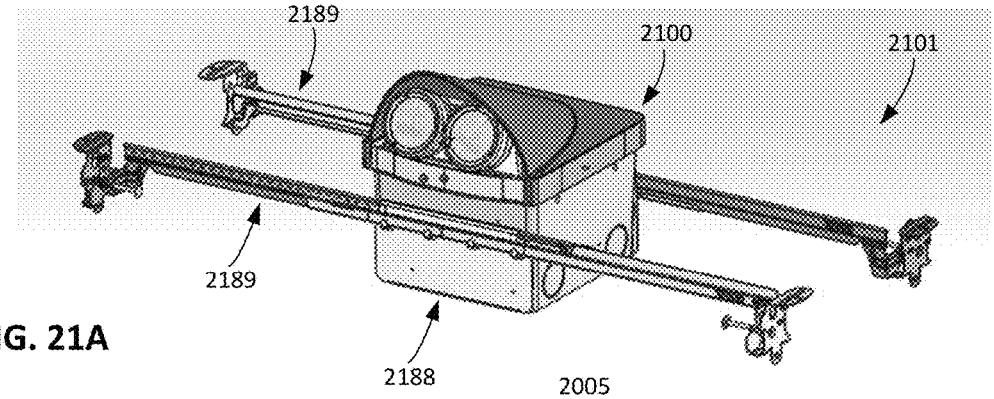
FIG. 21A
FIG. 21B
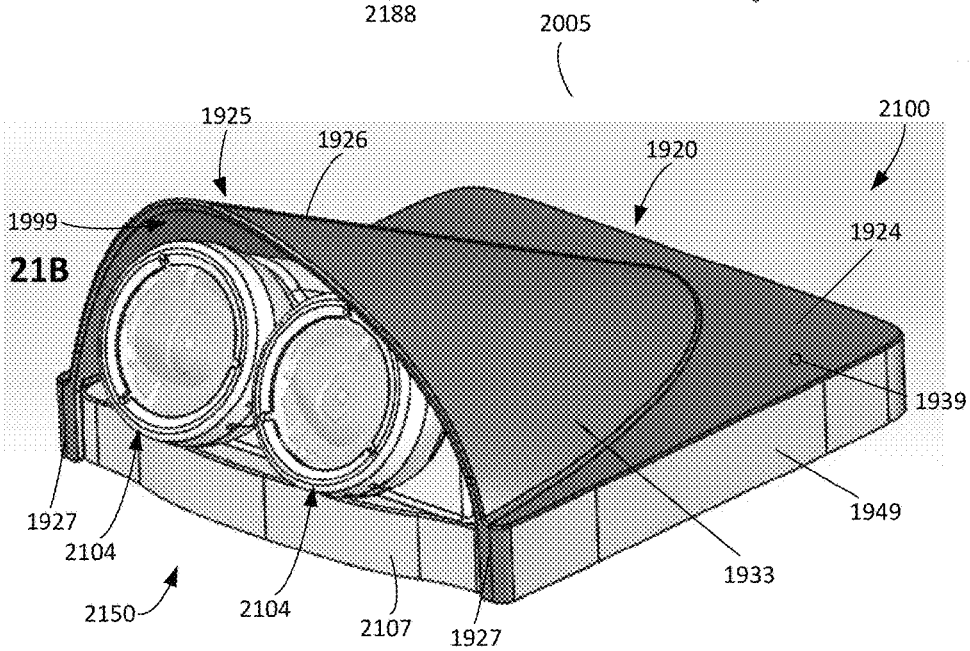

COVERS FOR EMERGENCY EGRESS LIGHT FIXTURES

CROSS-REFERENCE TO RELATED APPLICATIONS

This application claims priority under 35 U.S.C. § 119 to U.S. Provisional Patent Application Ser. No. 62/324,605, titled "Covers For Emergency Egress Light Fixtures" and filed on Apr. 19, 2016, the entire contents of which are hereby incorporated herein by reference.

TECHNICAL FIELD

Embodiments described herein relate generally to emergency egress lighting, and more particularly to covers for emergency egress light fixtures.

BACKGROUND

Emergency lighting is a requirement in most buildings and enclosed spaces. Emergency lighting is designed to activate during a power failure and to provide a path of egress lighting for people inside the building or enclosed space to safely exit the building. The emergency lighting must be installed and function according to certain codes and regulations, including NFPA, NEC, and UL924 (all described below). The activation of emergency lighting is an automatic process that must occur within a certain amount of time (e.g., 10 seconds) of the power failure. Emergency lighting must be tested once a month to verify proper function. This testing can be initiated in a number of ways, including manually through a mechanical switch, manually using a light beam, or automatically using software embedded in the electronics of the light fixture.

SUMMARY

In general, in one aspect, the disclosure relates to a lighting system that includes a light fixture comprising a body and at least one light source, where the light fixture is configured to couple to a structure. The lighting system can also include a cover having at least one first fixture coupling feature, where the at least one first fixture coupling feature detachably couples to the body of the light fixture, and where the cover physically covers at least a first portion of the body of the light fixture.

In another aspect, the disclosure can generally relate to a cover for a light fixture. The cover can include a cover body, and at least one coupling feature disposed on the cover body, where the at least one coupling feature is configured to detachably couple to a housing of the light fixture.

These and other aspects, objects, features, and embodiments will be apparent from the following description and the appended claims.

BRIEF DESCRIPTION OF THE DRAWINGS

The drawings illustrate only example embodiments of covers for emergency egress light fixtures and are therefore not to be considered limiting of its scope, as covers for emergency egress light fixtures may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

FIGS. 20A and 20B show the cover of FIG. 19 and a light fixture in accordance with certain example embodiments.

FIGS. 21A and 21B show the cover of FIG. 19 and another light fixture in accordance with certain example embodiments.

DETAILED DESCRIPTION OF EXAMPLE EMBODIMENTS

Figure 1:
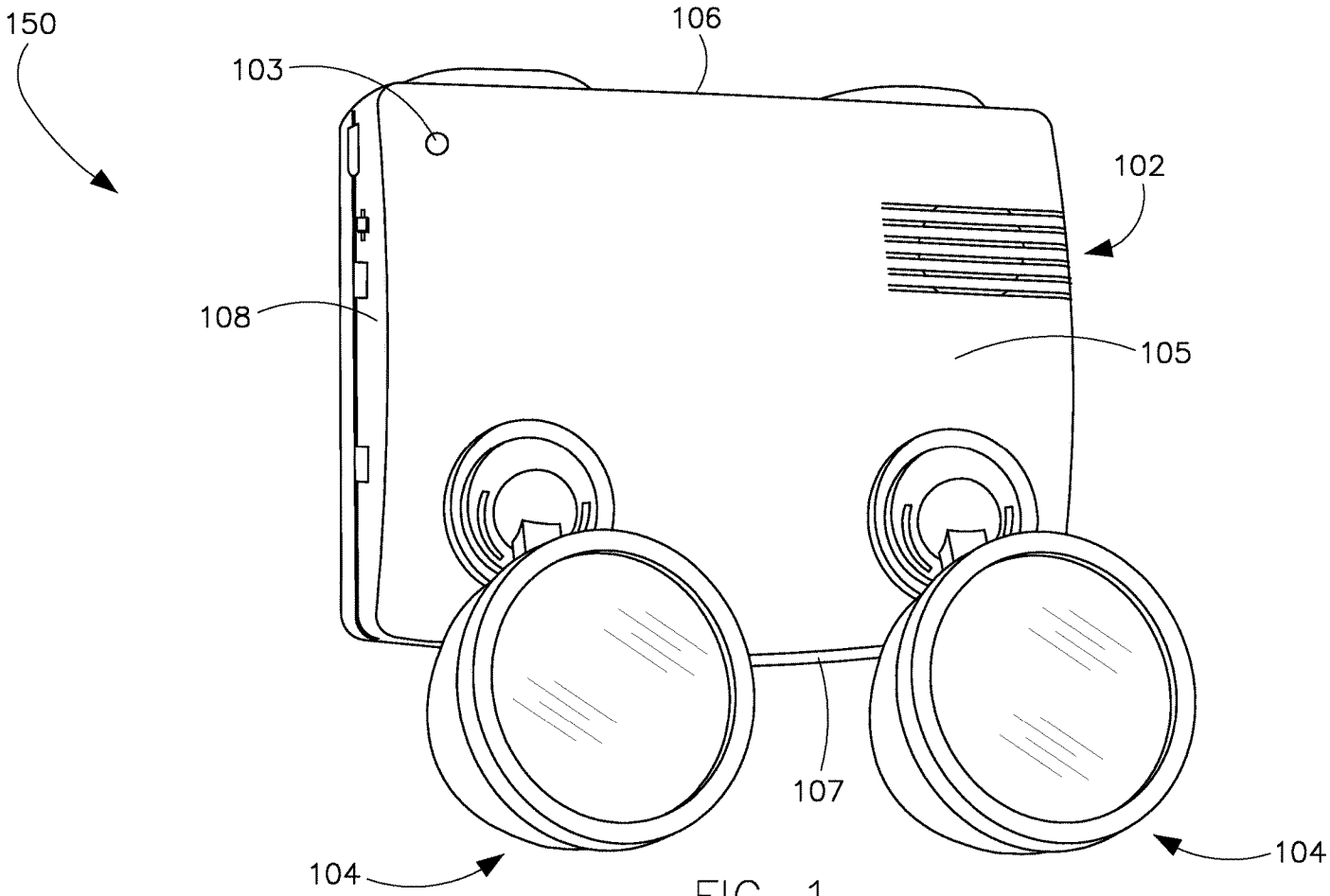
FIG. 1 PRIOR ART
FIG. 1 shows an emergency egress light fixture in accordance with embodiments known in the art.

The example embodiments discussed herein are directed to systems, methods, and devices for covers for emergency egress light fixtures. Certain example embodiments provide a number of benefits. Examples of such benefits include, but are not limited to, ease of installation and removal, field installation capability, low cost, improved aesthetics, customizable design, and full capability and use of the emergency egress light fixtures.

Example embodiments can be pre-fabricated or specifically generated (e.g., using 3-D printing, by shaping a malleable body) for a particular light fixture and/or environment. Example embodiments can have standard or customized features (e.g., shape, size, color, pattern, configuration). Therefore, example embodiments described herein should not be considered limited to creation or assembly at any particular location and/or by any particular person. Further, while example embodiments described herein are directed to emergency egress light fixtures, example embodiments can also be used with other types of light fixtures. Therefore, example embodiments described herein should not be considered limited to use with emergency egress light fixtures.

As defined herein, covering a light fixture (or portion thereof) using an example cover can mean that the cover is in direct physical contact with some or all of an outer surface of the light fixture. In addition, or in the alternative, covering a light fixture using an example cover can mean that the cover is disposed proximate to, but not in direct contact with, an outer surface of the light fixture. In such a case, the cover can obstruct the view of such portions of the light fixture from a user when a user stands in certain positions (e.g., directly in front) relative to the cover and light fixture. In any case, an example cover avoids (or at least substantially avoids) obstructing the light emitted by each light source of a light fixture.

The covers (or components thereof) described herein can be made of one or more of a number of suitable materials and/or can be configured in any of a number of ways to allow the light fixtures to meet certain standards and/or regulations while also maintaining reliability of the light fixtures, regardless of the one or more conditions under which the light fixtures can be exposed. Examples of such materials can include, but are not limited to, aluminum, stainless steel, fiberglass, glass, plastic, and rubber. An example cover (or portions thereof) can be flexible (e.g., malleable, resilient, bendable) or firm.

As discussed above, emergency egress light fixtures can be subject to complying with one or more of a number of standards, codes, regulations, and/or other requirements established and maintained by one or more entities. Examples of such entities can include, but are not limited to, Underwriters' Laboratories (UL), the National Electric Code (NEC), the Institute of Electrical and Electronics Engineers (IEEE), and the National Fire Protection Association (NFPA). For example, wiring (the wire itself and/or the installation of such wire) that electrically couples a base unit with a remote emergency light fixture may fall within one or more standards set forth in the National Electric Code (NEC). An example cover coupled to an emergency egress light fixture allows the light fixture to continue complying with such standards, codes, regulations, and/or other requirements. In other words, an example cover, when attached to an emergency egress light fixture, does not compromise compliance of the emergency egress light fixture with any applicable codes and/or standards.

Any example covers, or portions thereof, described herein can be made from a single piece (e.g., as from a mold, injection mold, die cast, 3-D printing process, extrusion process, stamping process, or other prototype methods). In addition, or in the alternative, an example cover (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As described herein, a user can be any person that interacts with a light fixture. Examples of a user may include, but are not limited to, an engineer, an electrician, a maintenance technician, a mechanic, an employee, a visitor, an operator, a consultant, a contractor, and a manufacturer's representative. Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling.

A coupling feature (including a complementary coupling feature) as described herein can allow one or more components and/or portions of a cover to become coupled, directly or indirectly, to another portion of a light fixture. A coupling feature can include, but is not limited to, a snap, Velcro, a clamp, a portion of a hinge, an aperture, a recessed area, a protrusion, a slot, a spring clip, a tab, a detent, and mating threads. One portion of an example cover can be coupled to a light fixture by the direct use of one or more coupling features.

In addition, or in the alternative, a portion of an example cover can be coupled to a light fixture using one or more independent devices that interact with one or more coupling features disposed on a component of the cover. Examples of such devices can include, but are not limited to, a pin, a hinge, a fastening device (e.g., a bolt, a screw, a rivet), epoxy, glue, adhesive, tape, and a spring. One coupling feature described herein can be the same as, or different than, one or more other coupling features described herein. A complementary coupling feature as described herein can be a coupling feature that mechanically couples, directly or indirectly, with another coupling feature.

Any component described in one or more figures herein can apply to any other figures having the same label. In other words, the description for any component of a figure can be considered substantially the same as the corresponding component described with respect to another figure. The numbering scheme for the components in the figures herein parallel the numbering scheme for the components of described in another figure in that each component is a three or four digit number having either the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of covers for emergency egress light fixtures will be described more fully hereinafter with reference to the accompanying drawings, in which example embodiments of covers for emergency egress light fixtures are shown. Covers for emergency egress light fixtures may, however, be embodied in many different forms and should not be construed as limited to the example embodiments set forth herein. Rather, these example embodiments are provided so that this disclosure will be thorough and complete, and will fully convey the scope of covers for emergency egress light fixtures to those of ordinary skill in the art. Like, but not necessarily the same, elements (also sometimes called components) in the various figures are denoted by like reference numerals for consistency.

Terms such as "first," "second," "top," "bottom," "left," "right," "end," "back," "front," "side", "length," "width," "inner," "outer," "lower", and "upper" are used merely to distinguish one component (or part of a component or state of a component) from another. Such terms are not meant to denote a preference or a particular orientation, and are not meant to limit embodiments of covers for emergency egress light fixtures. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows an emergency egress light fixture 150 in accordance with embodiments known in the art. The light fixture 150 includes a housing 102, one or more ancillary components 103 (e.g., sensors, cameras, indicating lights), and at least one light source 104. The housing 102 can include one or more walls (e.g., front wall 105 (also called a front surface 105 or a front side 105), bottom wall 107 (also called a bottom surface 107 or a bottom side 107), side wall 108 (also called a side surface 108, a right side 108, or a left side 108), top wall 106 (also called a top surface 106 or a top side 106)). One or more of these walls can have one or more features (e.g., decals, manufacturer's labels) disposed thereon, where the features unnecessarily draw the attention of a user or otherwise make the light fixture 150 aesthetically unappealing.

These various walls of the housing 102 can form a cavity (hidden from view) inside of which can be disposed the electrical components. The electrical components send and receive, directly or indirectly, power and/or control signals to the light fixture 150 and control the illumination of the light sources 104. Examples of the electrical components can include, but are not limited to, one or more electrical cables, electrical wires, the ancillary component 103, integrated circuits, discrete electrical components (e.g., resistors, capacitors, diodes), transformers, inverters, converters, terminal blocks, circuit boards, controllers, drivers, ballasts, batteries, and electrical connectors.

Each ancillary component 103 (e.g., sensor) of the light fixture 150 can be disposed in one of the walls (in this case, the front wall 105) of the housing 102. An ancillary component 103 can be any device that assists in the operation and/or testing of the light fixture 150. Alternatively, an ancillary component can be used in conjunction with some other system (e.g., security system). Examples of an ancillary component 103 can include, but are not limited to, a photo sensor, a laser detector, an infrared detector, a mechanical switch, a pushbutton, a camera, and a light-emitting diode (LED) (e.g., an indicating light). An ancillary component 103 can be disposed on the housing 102 of the light fixture 150. Alternatively, a sensor 103 can be disposed inside the housing 102 adjacent to an aperture in a wall of the housing 102. In either case, the ancillary component 103 can require an unobstructed path in order to function properly and/or be accessed. For example, as discussed above, per one or more applicable codes, there are monthly and yearly testing requirements that the user must meet to evaluate the operability of the emergency function of an emergency egress light fixture 150 by simulating a power outage. Enabling the ancillary component 103 (e.g., pressing a button, toggling a switch, activating a sensor) simulates this power outage for testing the light fixture 150.

Each light source 104 emits light when the light source 104 receives a power signal. Each light source 104 can be any of a number of different types of light source. Examples of light source types of a light source 104 can include, but are not limited to, incandescent lamps, light-emitting diodes (LEDs), halogen lamps, G10/GU10, G9/GU9, AR111/PAR36, T3, MR-11, and MR-16. If the light source 104 is a LED, the LED can be one or more of a number of types of LED technology, including but not limited to discrete LEDs, LED arrays, chip-on-board LEDs, edge lit LED panels, and surface mounted LEDs. A light source 104 can be a single source of light or multiple sources (e.g., an array) of light.

A light source 104 can also include one or more of a number of other components. Examples of such components can include, but are not limited to, an optical device (e.g., a lens, a refractor), a reflector, a body, and protective guard. A light source 104 can be mounted in or on the housing 102 of the light fixture 150. A light source 104 can have a fixed position relative to the housing 102. Alternatively, a light source 104 can have an adjustable position relative to the housing 102.

Figure 2A:
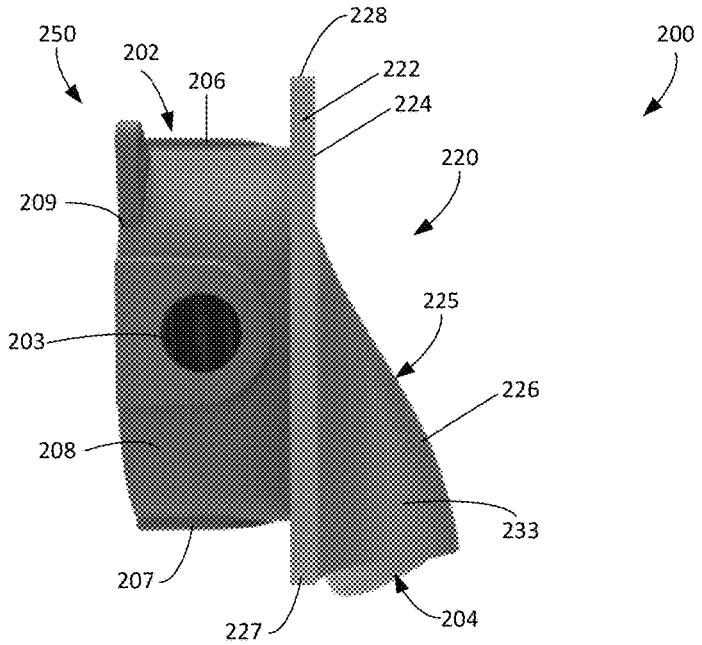
FIGS. 2A-14 show various covers for emergency egress light fixtures in accordance with certain example embodiments.
Figure 2B:
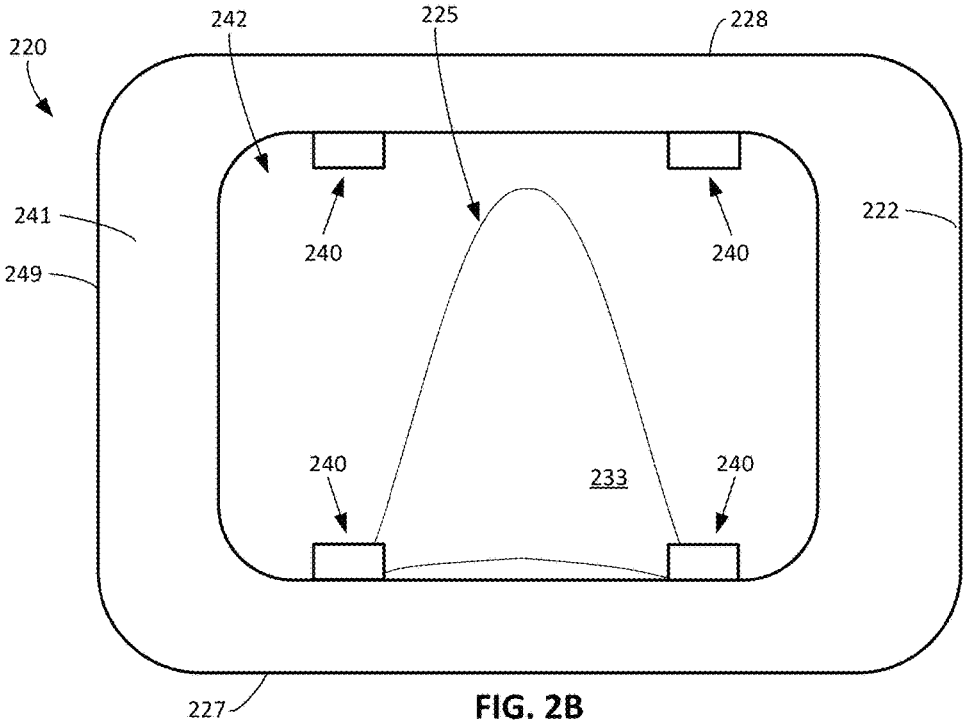
Figure 3:
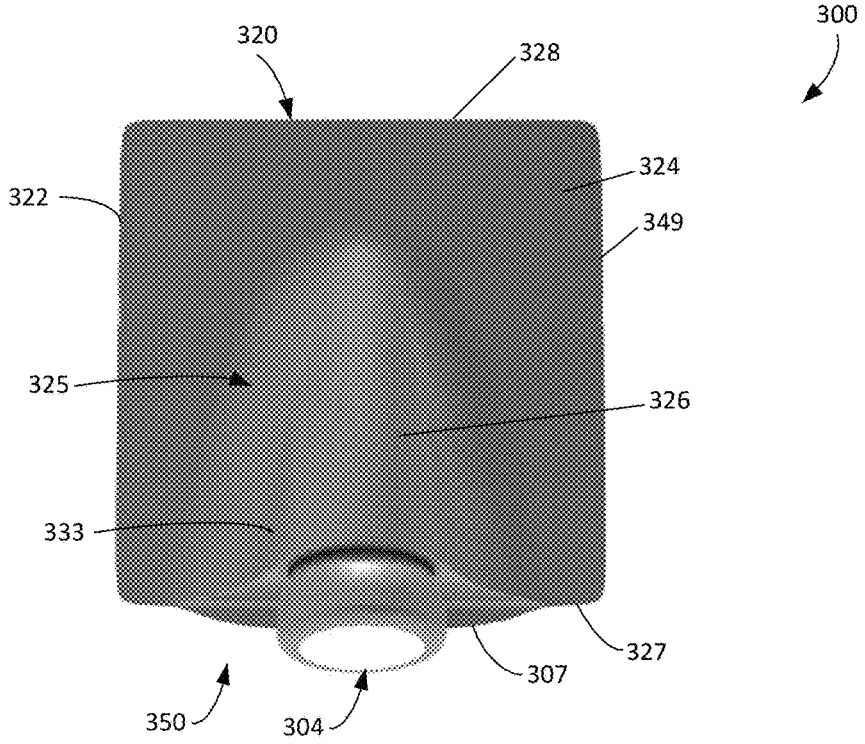
Figure 4:
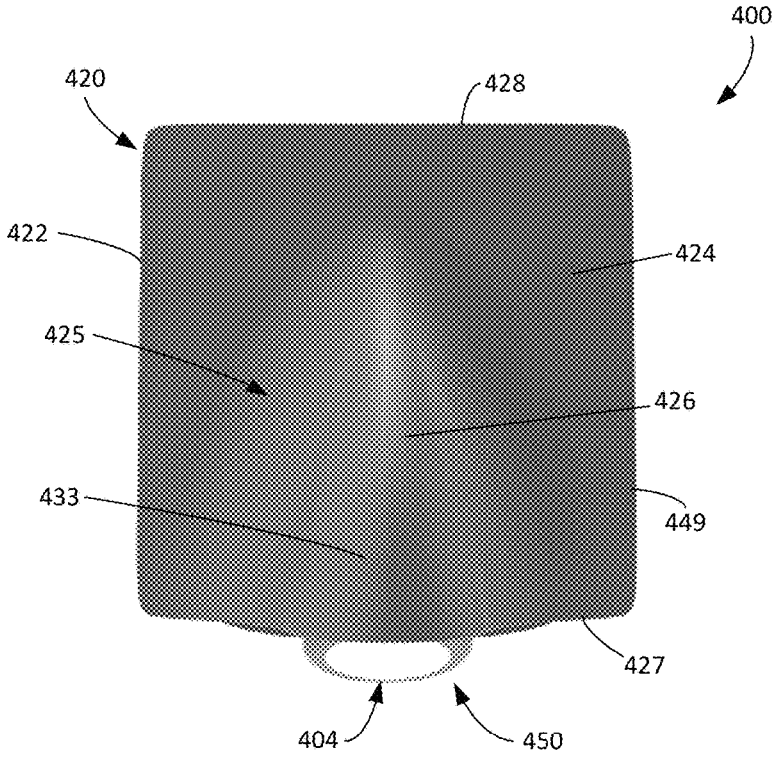

FIGS. 2A-14 show various covers for emergency egress light fixtures in accordance with certain example embodiments. Specifically, FIG. 2A shows a side view of a lighting system 200 that includes a light fixture 250 covered by an example cover 220. FIG. 2B shows a rear view of the cover 220 of FIG. 2A. FIG. 3 shows a front view of a lighting system 300 that includes a light fixture 350 covered by an example cover 320. FIG. 4 shows a front view of a lighting system 400 that includes a light fixture 450 covered by an example cover 420.

Figure 5:
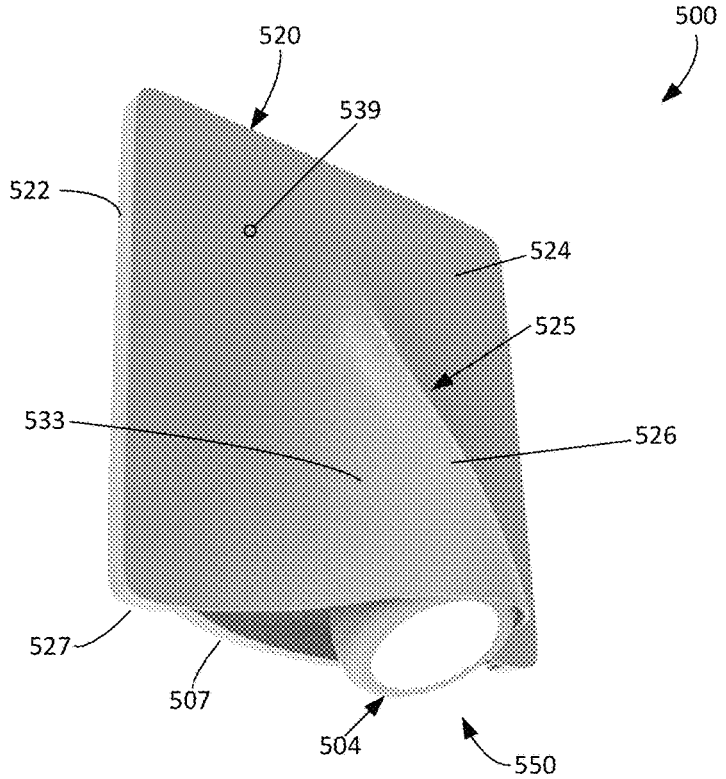
Figure 6:
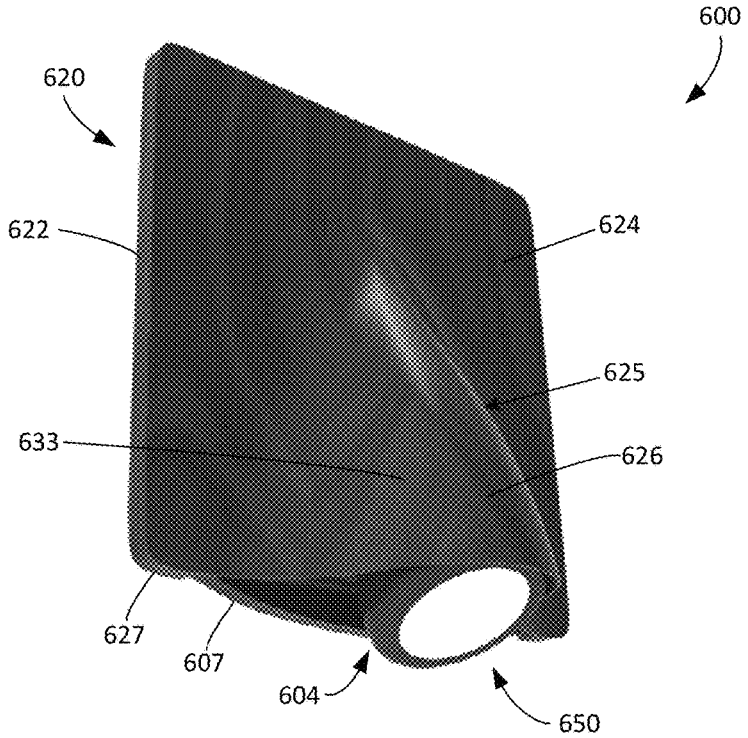

FIG. 5 shows a front-side perspective view of a lighting system 500 that includes a light fixture 550 covered by an example cover 520. FIG. 6 shows a front-side perspective view of a lighting system 600 that includes a light fixture 650 covered by an example cover 620.

Figure 7:
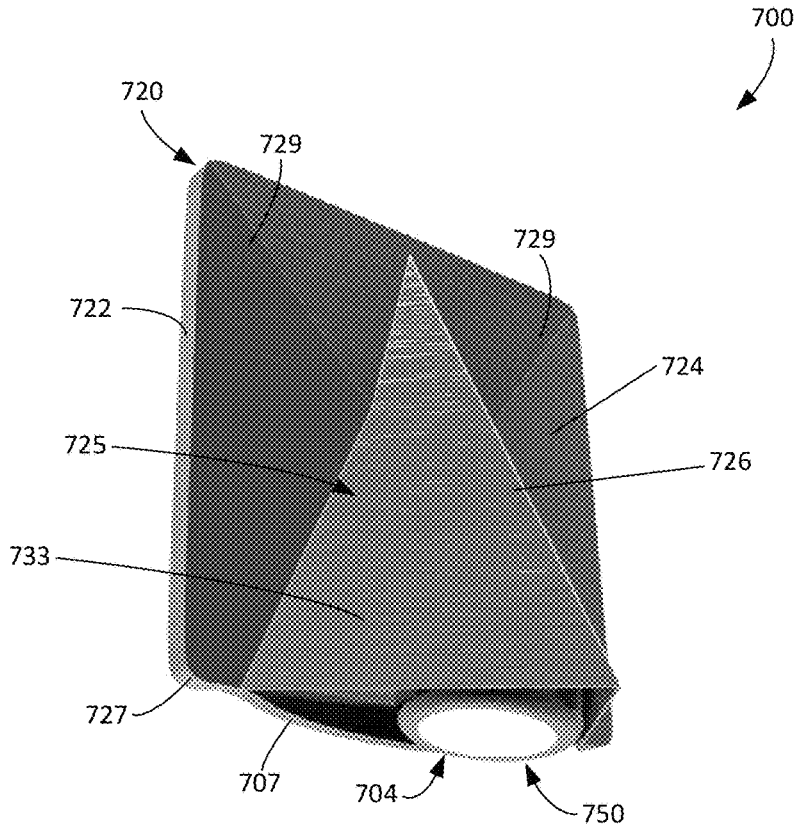
Figure 8:
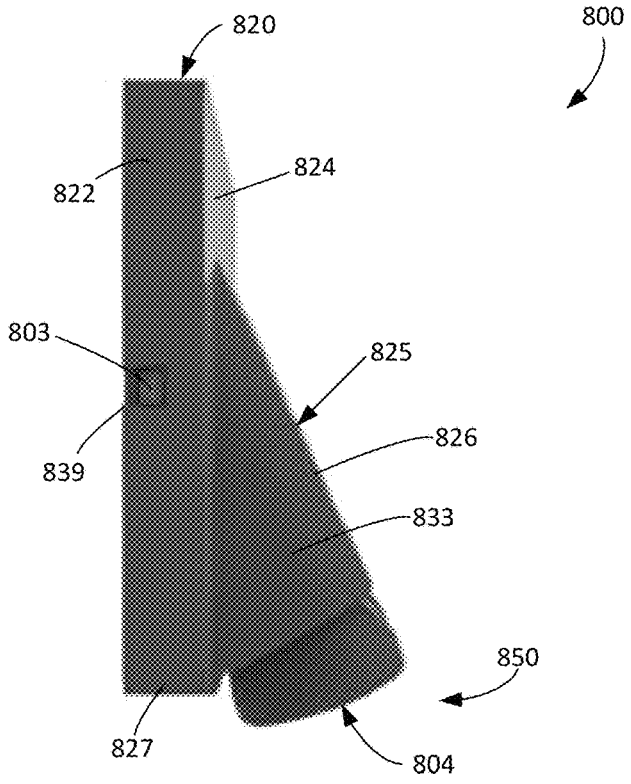
Figure 9:
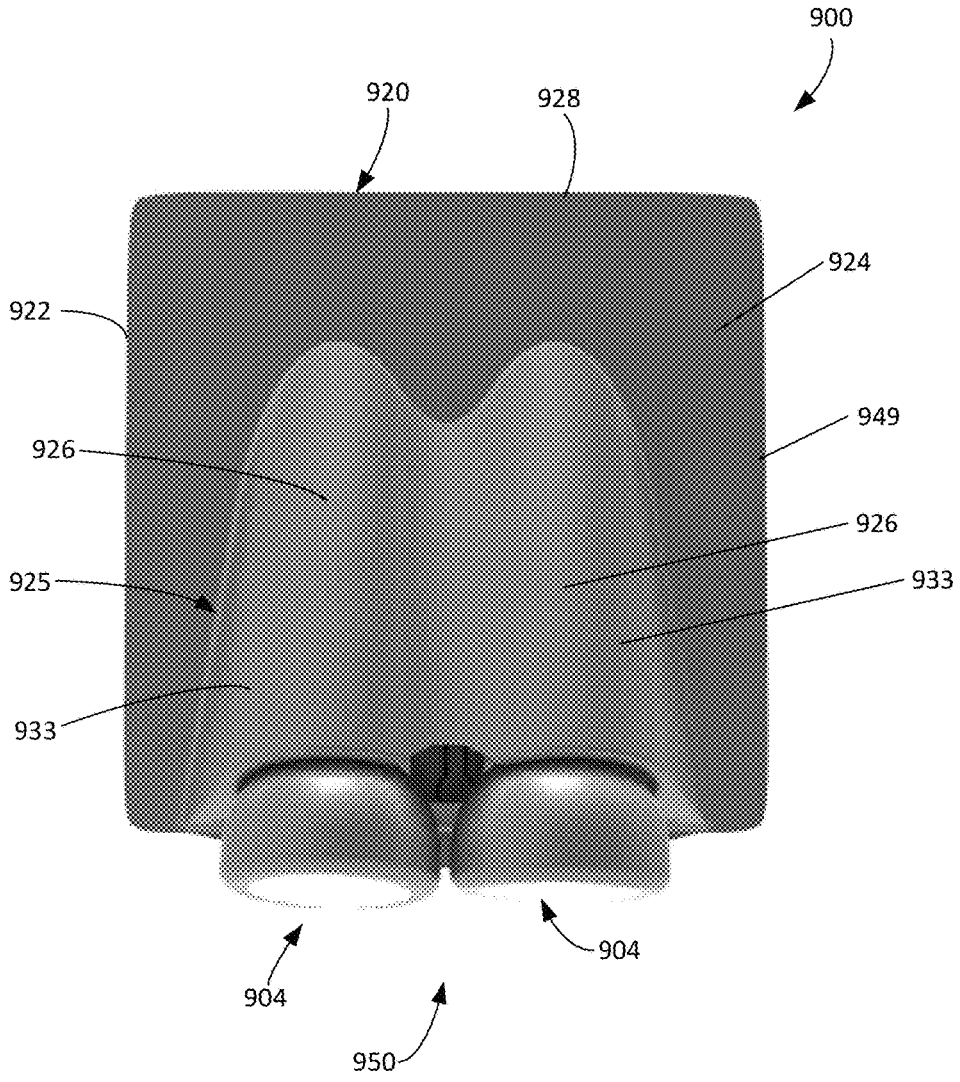
Figure 10A:
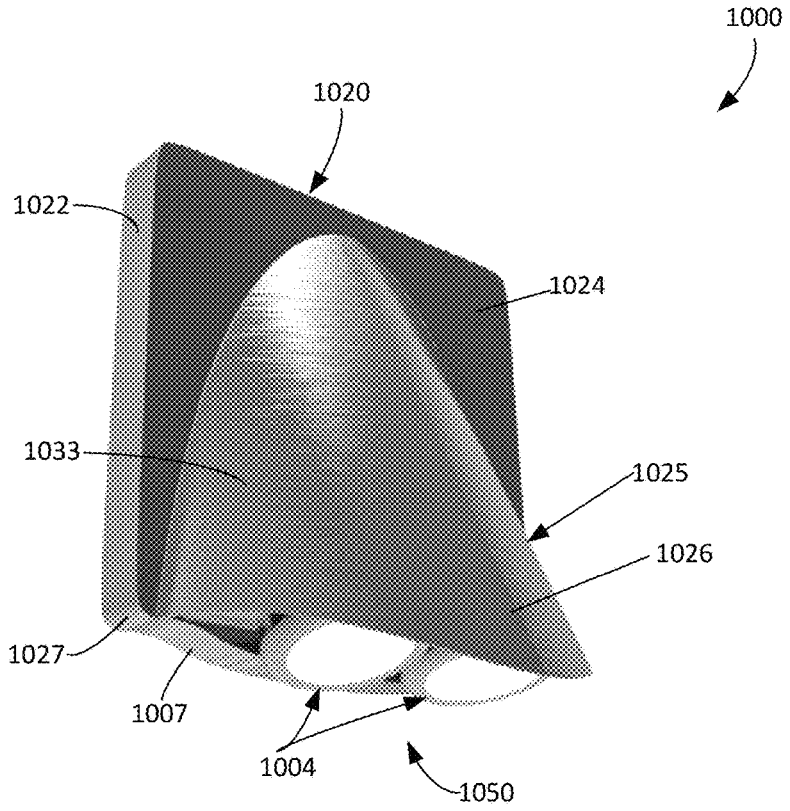
Figure 10B:
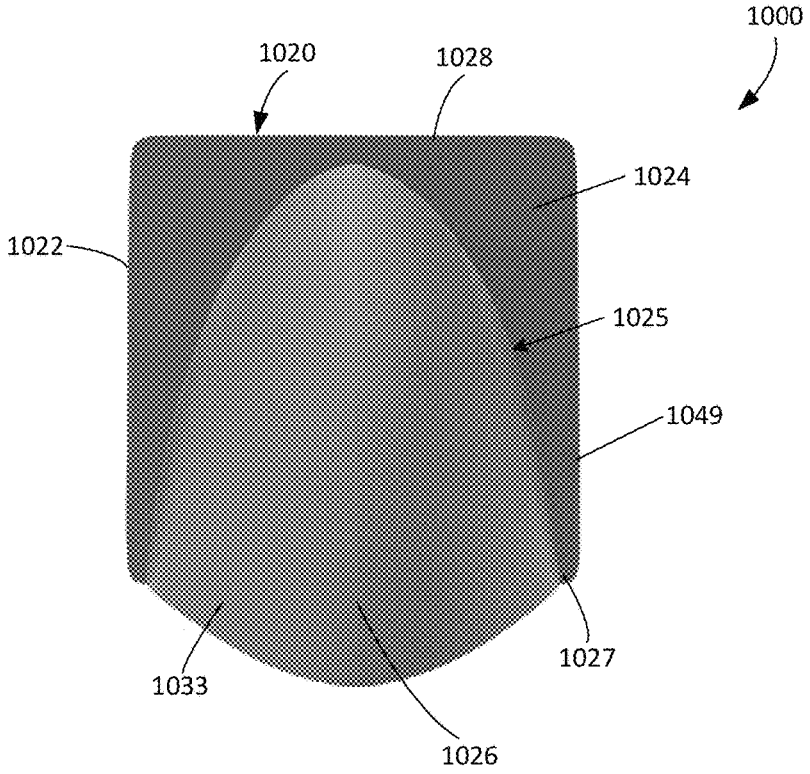

FIG. 7 shows a front-side perspective view of a lighting system 700 that includes a light fixture 750 covered by an example cover 720. FIG. 8 shows a side view of a lighting system 800 that includes a light fixture 850 covered by an example cover 820. FIG. 9 shows a front view of a lighting system 900 that includes a light fixture 950 covered by an example cover 920. FIGS. 10A and 10B show a front-side perspective view and a front view, respectively, of a lighting system 1000 that includes a light fixture 1050 covered by an example cover 1020.

Figure 11:
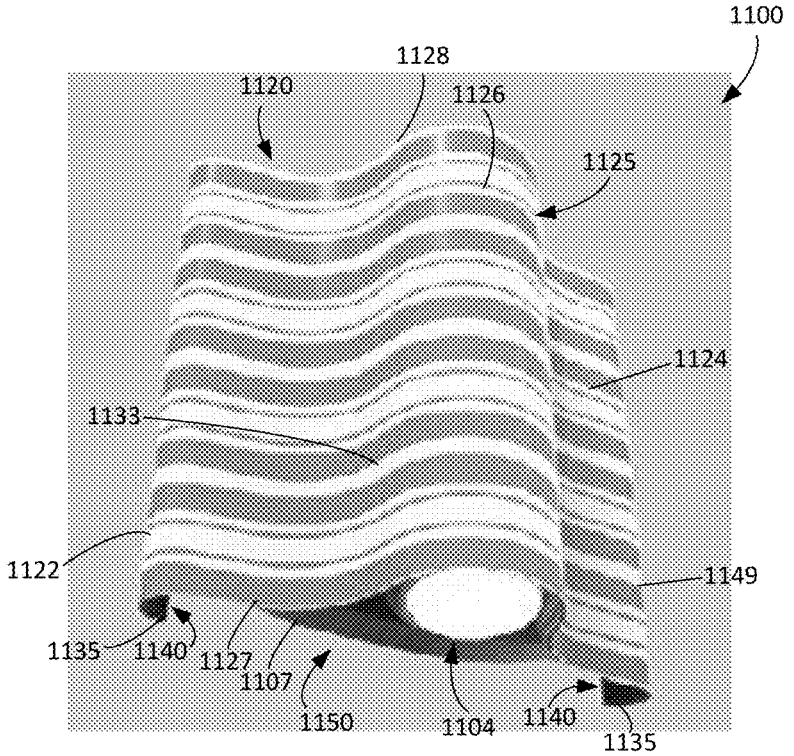
Figure 12:
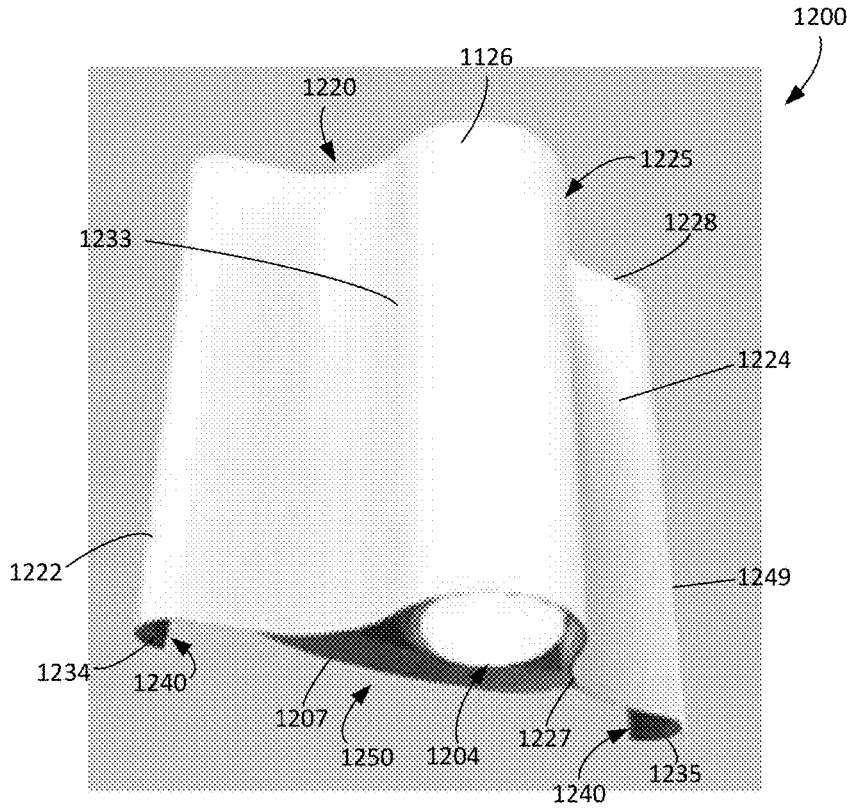
Figure 13:
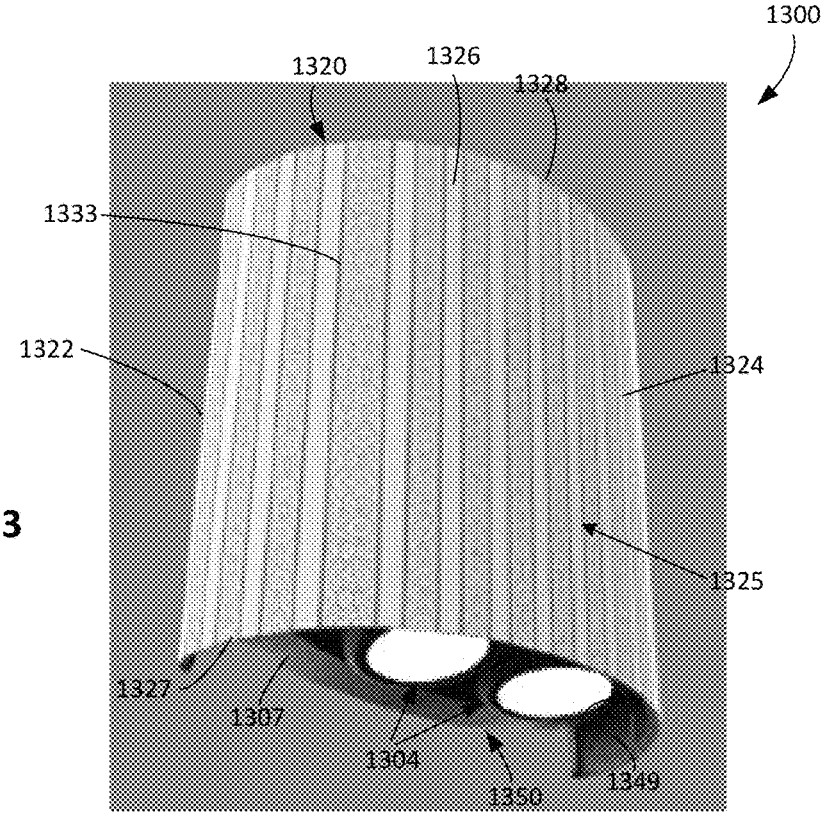
Figure 14:
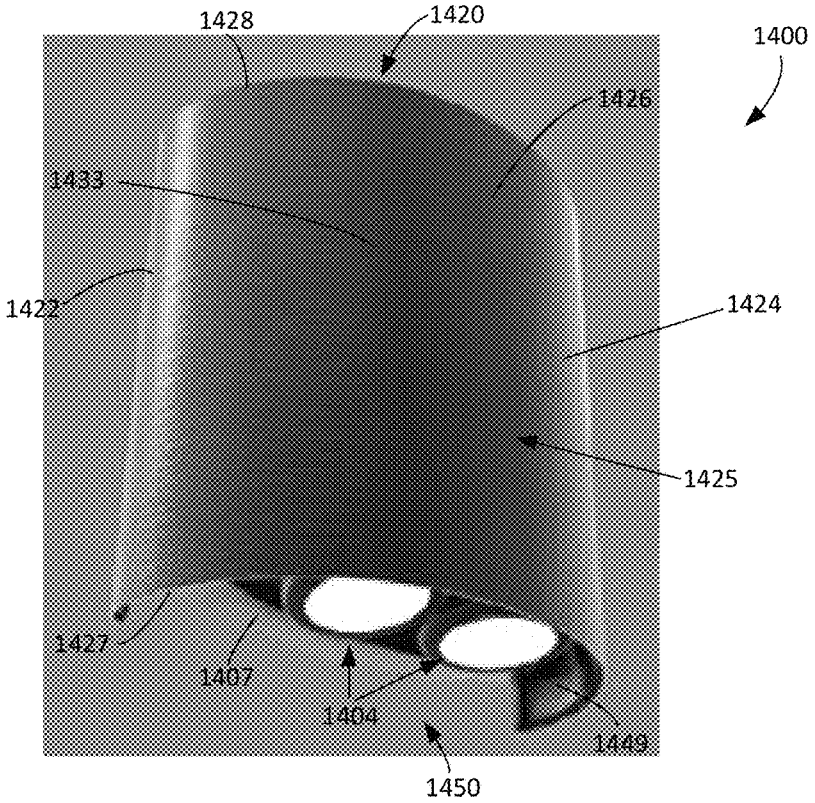

FIG. 11 shows a bottom-side perspective view of a lighting system 1100 that includes a light fixture 1150 covered by an example cover 1120. FIG. 12 shows a bottom-side perspective view of a lighting system 1200 that includes a light fixture 1250 covered by an example cover 1220. FIG. 13 shows a bottom-side perspective view of a lighting system 1300 that includes a light fixture 1350 covered by an example cover 1320. FIG. 14 shows a bottom-side perspective view of a lighting system 1400 that includes a light fixture 1450 covered by an example cover 1420.

Referring to FIGS. 1-14, the lighting system 200 of FIG. 2A shows an example cover 220 that covers the front wall (hidden from view) and most of the light source 204 of the light fixture 250. In this way, when viewed from the front, the cover 220, and not most of the light fixture 250, can be seen by a user. In this case, most of the side walls 208, the bottom wall 207, the back wall 209 (also sometimes called a back plate 209), and the top wall 206 of the light fixture 250 are not directly covered by the example cover 220. In this way, when viewed from the side, bottom, or top, most of the light fixture 250 can be seen by a user.

The light fixture 250 in this example includes an ancillary component 203 disposed in the left side wall 208 of the housing 202, and so the configuration of the cover 220 relative to the light fixture 250 in this case provides an unobstructed path for the ancillary component 203. The back wall 20 of the housing 202 can be mounted against a wall or other object or feature within a room. In certain example embodiments, a light fixture 250 that is covered by an example cover 220 can be mounted on a wall, on a ceiling, in a corner, and/or any other location (collectively called a "structure" herein) where a light fixture 250 can be found.

The length (e.g., distance between left side 222 (also sometimes called a left surface 222) and right side 249 (also sometimes called a right surface 249)) and/or the height (e.g., distance between the top side 228 (also sometimes called a top surface 228) and the bottom side 227 (also sometimes called a bottom surface 227)) of the cover 220 can be greater than the length and/or height of the housing 202, with or without the light sources 204, of the light fixture. For example, in this case, the flange 241 that forms a border around the back side of the cover 220 can represent the excess length and height of the cover 220 relative to the housing 202 of the light fixture 250. As a result, a front-side view could hide most, if not all, of the light fixture 250 without the cover 220 actually contacting most of the light fixture 250.

Since the light source 204 of the light fixture 250 protrudes outward and downward relative to the front wall of the housing 202 of the light fixture 250, the cover 220 can include one or more of a number of features 225 (also called a light source feature 225) that accommodate one or more light sources 204, regardless of whether the light source 204 is moveable relative to the housing 202 of the light fixture 250.

In certain example embodiments, the light source feature 225 can be one or more of a number (in the case of FIG. 2, one; in the case of FIG. 9, two) of outward protrusions 233 from and relative to the front surface 224 of the cover 220. Each outward protrusion 233 can have an apex 226 that represents the maximum distance of the outward protrusion 233 from the front surface 224 along a horizontal line across the cover 220 The protrusion 233 can be a smooth curve (as shown in FIG. 2), Alternatively, as shown in FIG. 7, the protrusion 733 (as well as the rest of the front surface 724) can be multiple planar segments. Similarly, the apex of a light source feature can be smooth (as with the apex 226 of FIG. 2), pointed (as with the apex 726 of FIG. 7), and/or have any of a number of other shapes and/or configurations.

As discussed above, the light source feature 925 of FIG. 9 includes two substantially identical protrusion 933, where each protrusion 933 covers at least part of a light source 904. Alternatively, the light source feature 1025 of FIGS. 10A and 10B includes one large protrusion 1033 that provides enough space to cover multiple light sources 1004. In this case, the light source feature 1025 completely covers the light sources of the light fixture when viewed from the front. In such a case, the inner surface of the protrusion 1033 can include a reflective material to help direct the light emitted by the light sources.

The front surface of a cover can be substantially flat, as with the front surface 424 of FIG. 4. Alternatively, the front surface of a cover can have one or more of a number of features. For example, the front surface 724 of FIG. 7 can be a number of planar segments where adjacent planar segments are joined at junctions 729. As yet another alternative, the front surface of a cover can form a single curvature. For example, the front surface 1324 of the cover 1320 in FIG. 13 and the front surface 1424 of the cover 1420 in FIG. 14 can have a semi-elliptical shape when viewed from above. In this way, the shape of the front surface 1324 and the front surface 1424 preclude the need for a specific light source feature.

As yet another alternative, the front surface of a cover can have a number of curvatures. For example, the front surface 1124 of the cover 1120 in FIG. 11 and the front surface 1224 of the cover 1220 in FIG. 12 can have a flowing ribbon or banner shape when viewed from above. In such a configuration, looking at FIG. 11, the side edges 1135 fold under and so do not form the left side 1122 and the right side 1149 of the cover 1120. As a result, the side edges 1135 can include, or can be, coupling features 1140 to couple the cover 1120 to the light fixture 1150. In these cases, the shape of the light source feature 1125 and the light source feature 1225 runs consistently along the height of the cover 1120 and the cover 1220, respectively.

The cover 220 can couple to one or more portions (e.g., the housing 202) of the light fixture 250 using one or more of a number of coupling features 240. The cover 220 can couple to the light fixture 250 mechanically, chemically, magnetically, using some other principal of science, or any combination thereof. Examples of coupling features (e.g., coupling features 240) of an example cover (e.g. cover 220) can include, but are not limited to, a snap, Velcro, a clamp, a portion of a hinge, a magnet, an aperture, a recessed area, a protrusion, a slot, a spring clip, a tab, a detent, thread, an elastic band, a suction cup, a string, and mating threads. One portion of an example cover 220 can be coupled to a light fixture 250 by the direct use of one or more coupling features.

In addition, or in the alternative, a coupling feature of an example cover 220 can be coupled to another coupling feature (or other portion) of a light fixture 250 using one or more independent devices that interact with one or more coupling features of the cover 220. Examples of such devices can include, but are not limited to, a pin, a hinge, a fastening device (e.g., a bolt, a screw, a rivet), epoxy, glue, adhesive, tape, and a spring. One coupling feature described herein can be the same as, or different than, one or more other coupling features described herein. A complementary coupling feature as described herein can be a coupling feature that mechanically couples, directly or indirectly, with another coupling feature.

A coupling feature 240 of a cover 220 can be disposed at any location of the cover 220. For example, as shown in FIG. 2B, each coupling feature 240 can be disposed along an inner surface of the collar 241 on the back side of the cover 220, within a recess 242. In certain example embodiments, rather than coupling to a portion of the light fixture 250, a coupling feature 240 of the cover 220 can couple to an object or device located adjacent to the light fixture 250. Examples of such objects or devices can include, but are not limited to, a ceiling tile, a wall, a ceiling, a conduit, and a speaker.

As discussed above, a light source feature of a cover can have any of a number of shapes, sizes, and/or features. For example, as shown in FIG. 3, the light source feature 325 of cover 320 can cover only a minimal portion of a light source 304 of the light fixture 350. Alternatively, as shown in FIG. 4, the light source feature 425 of cover 420 can cover substantially all of a light source 304 of the light fixture 350.

As shown with the cover 520 of FIG. 5 and the cover 620 of FIG. 6, the outer surface of a cover can have any one or more of a number of colors, textures, patterns, and/or other features to help the cover better blend in with the environment surrounding the light fixture. For example, the one or more portions (e.g., front surface 524, light source feature 525) of a cover (e.g., cover 520) can have a surface configured to receive paint, wallpaper, a magnetic overlay, laser printing, and/or any other similar covering or coating.

As discussed above, light fixture can include one or more sensors. In such a case, an example cover can allow the sensor to have an unobstructed path in order to function properly. For example, as shown in FIG. 5, an aperture 539 in the front surface 524 of the cover 520 aligns with the position of a sensor (hidden from view) of the light fixture 550, allowing the sensor to operate properly. Similarly, as shown in FIG. 8, an aperture 839 in the right side 822 of the cover 820 aligns with the position of an ancillary component 803 of the light fixture 550, allowing the ancillary component 803 to operate properly. Alternatively, the aperture 839 in the cover 820 can be a coupling feature 840 that couples to a complementary coupling features in the side wall of the light fixture 850.

For the lighting system 300 of FIG. 3, the light fixture 350 has only one light source 304. The example cover 320 has a front surface 324, a top surface 328, a left surface 322, a bottom surface 327, and a right surface 349. This example cover 320 includes a light source feature 325 that includes a single curved outward protrusion 333 from and relative to the front surface 324 of the cover 320. The curved outward protrusion 333 having apex 326 in this example leaves most of the light source 304 and part of the bottom wall 307 of the light fixture 350 uncovered by the cover 320. In this case, the front surface 324, the top surface 328, the left surface 322, the bottom surface 327, and the right surface 349 of the cover 320 make direct contact with the light fixture 350. Also, the light source feature 325 avoids making direct contact with the light fixture 350, but still hides a portion of the light fixture 350 from view of a user.

For the lighting system 400 of FIG. 4, the light fixture 450 has only one light source 404. The example cover 420 of FIG. 4 has contours similar to the cover 320 of FIG. 3 and includes has a front surface 424, a top surface 428, a left surface 422, a bottom surface 427, and a right surface 449. This example cover 420 includes a light source feature 425 that includes a single curved outward protrusion 433 from and relative to the front surface 424 of the cover 420. The curved outward protrusion 433 having apex 426 in this example covers most of the light source 404 and the bottom wall of the light fixture 450. In this case, the front surface 424, the top surface 428, the left surface 422, the bottom surface 427, and the right surface 449 of the cover 420 make direct contact with the light fixture 450. Also, the light source feature 425 avoids making direct contact with the light fixture 450, but still hides a portion of the light fixture 450 from view of a user.

For the lighting system 500 of FIG. 5, in addition to what is described above, the light fixture 550 has only one light source 504. The example cover 520 has a front surface 524, a top surface 528, a left surface 522, a bottom surface 527, and a right surface 549. This example cover 520 includes a light source feature 525 that includes a single curved outward protrusion 533 from and relative to the front surface 524 of the cover 520. The curved outward protrusion 533 having apex 526 in this example covers most of the light source 504 and the bottom wall 507 of the light fixture 550. In this case, the front surface 524, the top surface 528, the left surface 522, the bottom surface 527, and the right surface 549 of the cover 520 make direct contact with the light fixture 550. Also, the light source feature 525 avoids making direct contact with the light fixture 550, but still hides a portion of the light fixture 550 from view of a user.

For the lighting system 600 of FIG. 6, the light fixture 650 has only one light source 604. The example cover 620 has a front surface 624, a top surface 628, a left surface 622, a bottom surface 627, and a right surface 649. This example cover 620 includes a light source feature 625 that includes a single curved outward protrusion 633 from and relative to the front surface 624 of the cover 620. The curved outward protrusion 633 having apex 626 in this example covers most of the light source 604 and the bottom wall 607 of the light fixture 650. In this case, the front surface 624, the top surface 628, the left surface 622, the bottom surface 627, and the right surface 649 of the cover 620 make direct contact with the light fixture 650. Also, the light source feature 625 avoids making direct contact with the light fixture 650, but still hides a portion of the light fixture 650 from view of a user.

For the lighting system 700 of FIG. 7, in addition to what is described above, the light fixture 750 has only one light source 704. The example cover 720 has a front surface 724, a top surface 728, a left surface 722, a bottom surface 727, and a right surface 749. This example cover 720 includes a light source feature 725 that includes two planar outward protrusions 733 from and relative to the front surface 724 of the cover 720. The planar outward protrusions 733 having apex 726 in this example cover most of the light source 704 and the bottom wall 707 of the light fixture 750. In this case, the front surface 724, the top surface 728, the left surface 722, the bottom surface 727, and the right surface 749 of the cover 720 make direct contact with the light fixture 750. Also, the light source feature 725 avoids making direct contact with the light fixture 750, but still hides a portion of the light fixture 750 from view of a user.

For the lighting system 800 of FIG. 8, in addition to what is described above, the light fixture 850 has only one light source 804. The example cover 820 has a front surface 824, a top surface, a left surface 822, a bottom surface 827, and a right surface. This example cover 820 includes a light source feature 825 that includes a single curved outward protrusion 833 from and relative to the front surface 824 of the cover 820. The curved outward protrusion 833 having apex 826 in this example leaves most of the light source 804 and the bottom wall of the light fixture 850 uncovered by the cover 820. In this case, the front surface 824, the top surface, the left surface 822, the bottom surface 827, and the right surface of the cover 820 make direct contact with the light fixture 850. Also, the light source feature 825 avoids making direct contact with the light fixture 850, but still hides a portion of the light fixture 850 from view of a user.

For the lighting system 900 of FIG. 9, in addition to what is described above, the light fixture 950 has two light sources 904. The example cover 920 has a front surface 924, a top surface 928, a left surface 922, a bottom surface 927, and a right surface 949. This example cover 920 includes a light source feature 925 that includes two curved outward protrusions 933 (one for each light source 904) from and relative to the front surface 924 of the cover 920. Each of the two curved outward protrusions 933 having apex 926 in this example leave most of the light source 904 and the bottom wall of the light fixture 950 uncovered by the cover 920. In this case, the front surface 924, the top surface 928, the left surface 922, the bottom surface 927, and the right surface 949 of the cover 920 make direct contact with the light fixture 950. Also, the light source feature 925 avoids making direct contact with the light fixture 950, but still hides a portion of the light fixture 950 from view of a user.

For the lighting system 1000 of FIGS. 10A and 10B, the light fixture 1050 has two light sources 1004. The example cover 1020 has a front surface 1024, a top surface 1028, a left surface 1022, a bottom surface 1027, and a right surface 1049. This example cover 1020 includes a light source feature 1025 that includes a single curved outward protrusion 1033 from and relative to the front surface 1024 of the cover 1020. The curved outward protrusion 1033 having apex 1026 in this example covers the light sources 1004 and the bottom wall 1007 of the light fixture 1050. In this case, the front surface 1024, the top surface 1028, the left surface 1022, the bottom surface 1027, and the right surface 1049 of the cover 1020 make direct contact with the light fixture 1050. Also, the light source feature 1025 avoids making direct contact with the light fixture 1050, but still hides most of the light fixture 1050 from view of a user.

For the lighting system 1100 of FIG. 11, in addition to what is described above, the light fixture 1150 has only one light source 1104. The example cover 1120 has a front surface 1124, a top surface 1128, a left surface 1122, a bottom surface 1127, and a right surface 1149. This example cover 1120 includes a light source feature 1125 that includes a curved outward protrusion 1133 from and relative to the front surface 1124 of the cover 1120. The curved outward protrusion 1133 having apex 1126 in this example leaves most of the light source 1104, as well as some of the front surface 1124 and the bottom wall, of the light fixture 1150 uncovered by the cover 1120. In this case, the front surface 1124, the top surface 1128 (if enclosed), the left surface 1122, the bottom surface 1127 (if enclosed), and the right surface 1149 of the cover 1120 make direct contact with the light fixture 1150. Also, the light source feature 1125 avoids making direct contact with the light fixture 1150, but still hides a portion of the light fixture 1150 from view of a user.

For the lighting system 1200 of FIG. 12, in addition to what is described above, the light fixture 1250 has only one light source 1204. The example cover 1220 has a front surface 1224, a top surface 1228, a left surface 1222, a bottom surface 1227, and a right surface 1249. This example cover 1220 includes a light source feature 1225 that includes a curved outward protrusion 1233 from and relative to the front surface 924 of the cover 1220. The curved outward protrusion 1233 having apex 1226 in this example leaves most of the light source 1204, as well as some of the front surface 1224 and the bottom wall, of the light fixture 1250 uncovered by the cover 1220. In this case, the front surface 1224, the top surface 1228 (if enclosed), the left surface 1222, the bottom surface 1227 (if enclosed), and the right surface 1249 of the cover 1220 make direct contact with the light fixture 1250. Also, the light source feature 1225 avoids making direct contact with the light fixture 1250, but still hides a portion of the light fixture 1250 from view of a user.

For the lighting system 1300 of FIG. 13, in addition to what is described above, the light fixture 1350 has two light sources 1304. The cover 1320 can have a semi-elliptical shape when viewed from above. In this way, the shape of the front surface 1324 can preclude the need for a specific light source feature 1325. Put another way, the front surface 1324 and the protrusion 1333 of the light source feature 1325 are the same for cover 1320. Aside from the front surface 1324, the cover 1320 has a top surface 1328, a left surface 1322, a bottom surface 1327, and a right surface 1349. In this case, the front surface 1324, the top surface 1328, the left surface 1322, the bottom surface 1327, and the right surface 1349 of the cover 1320 make direct contact with the light fixture 1350. Also, the light source feature 1325 avoids making direct contact with the light fixture 1350, but still hides a portion of the light fixture 1350 from view of a user.

For the lighting system 1400 of FIG. 14, in addition to what is described above, the light fixture 1450 has two light sources 1404. The cover 1420 can have a semi-elliptical shape when viewed from above. In this way, the shape of the front surface 1424 can preclude the need for a specific light source feature 1425. Put another way, the front surface 1424 and the protrusion 1433 of the light source feature 1425 are the same for cover 1420. Aside from the front surface 1424, the cover 1420 has a top surface 1428, a left surface 1422, a bottom surface 1427, and a right surface 1449. In this case, the front surface 1424, the top surface 1428, the left surface 1422, the bottom surface 1427, and the right surface 1449 of the cover 1420 make direct contact with the light fixture 1450. Also, the light source feature 1425 avoids making direct contact with the light fixture 1450, but still hides a portion of the light fixture 1450 from view of a user.

Figure 15:
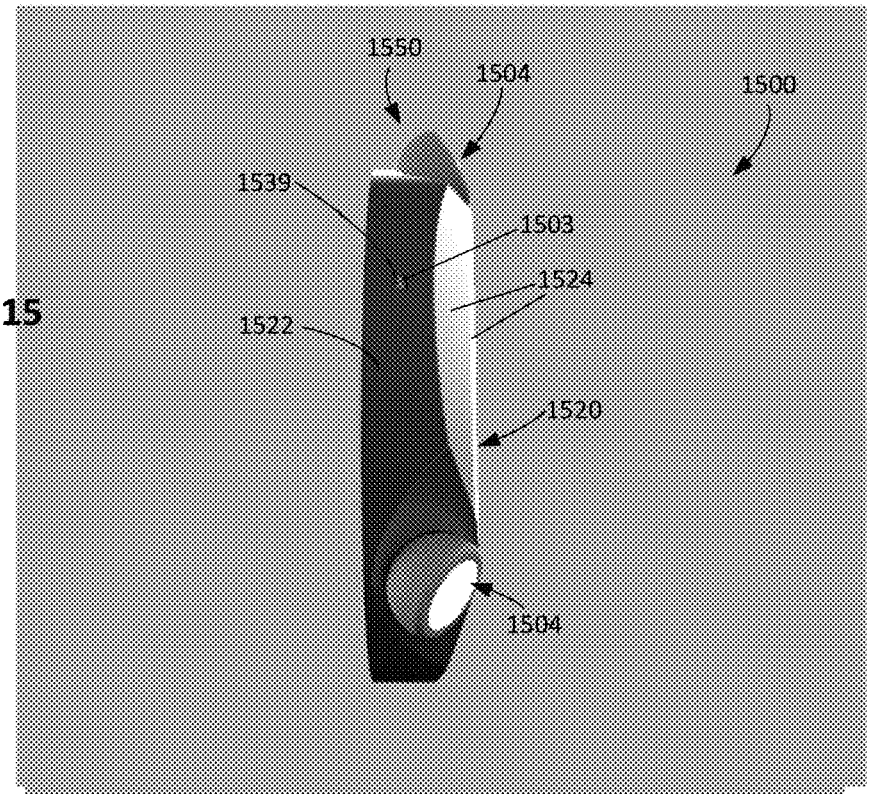
FIGS. 15-18 shows various covers for a different style of emergency egress light fixture in accordance with certain example embodiments.
Figure 16:
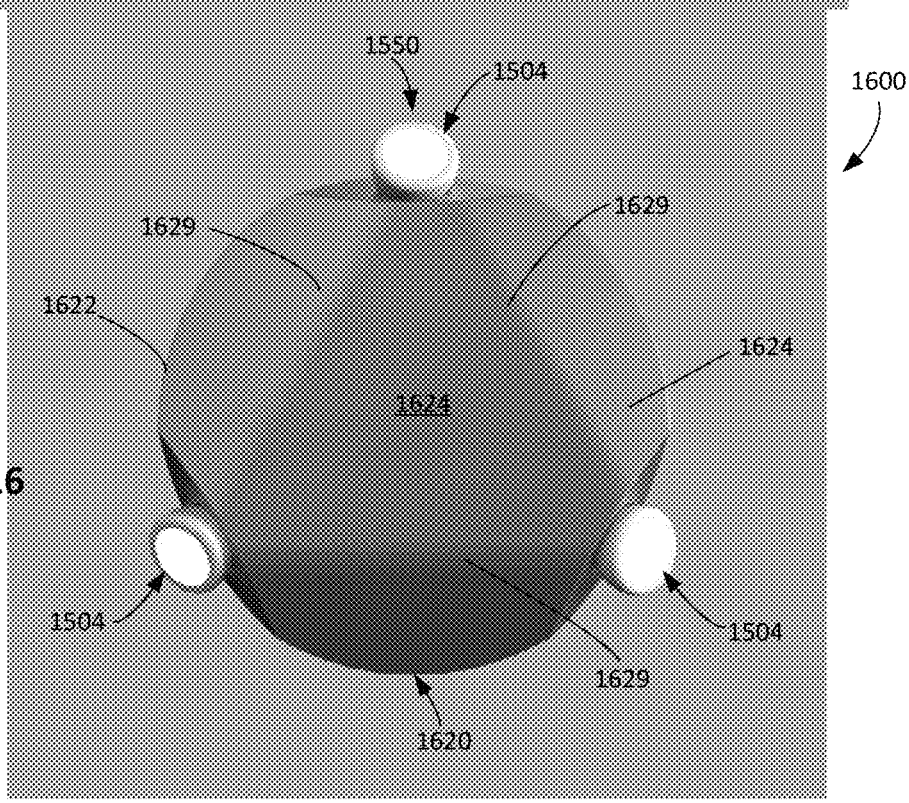
Figure 17:
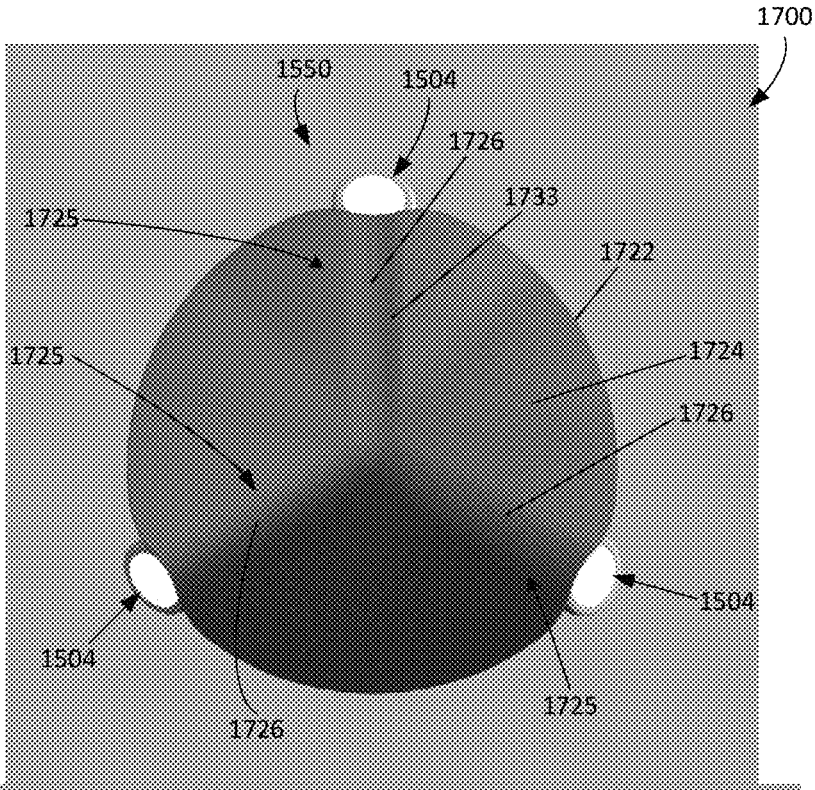
Figure 18:
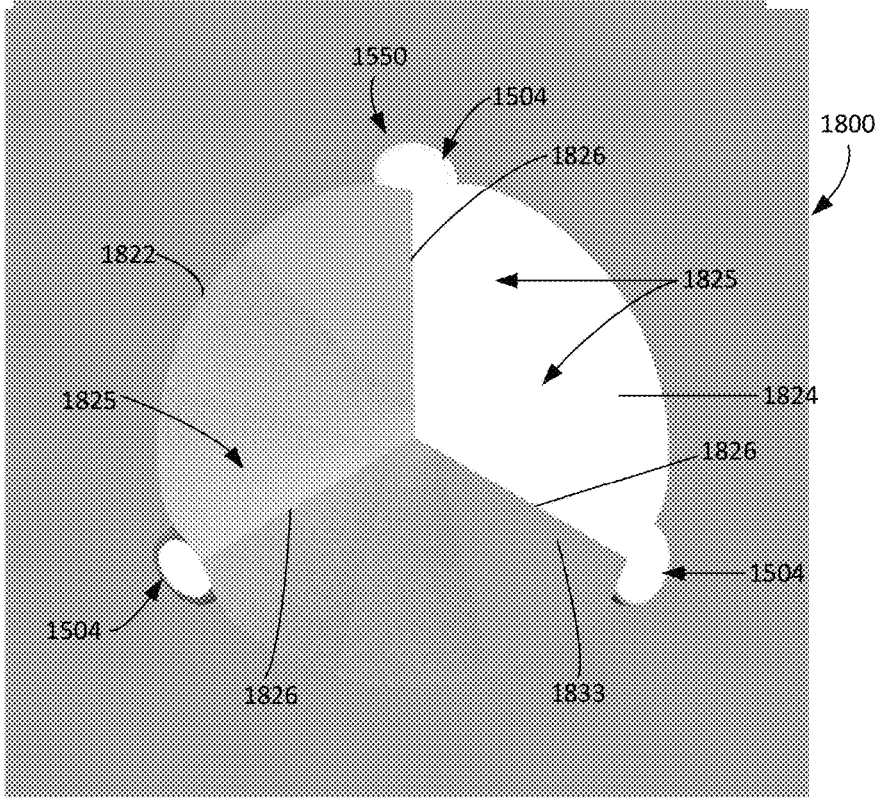

FIGS. 15-18 shows various covers for a different style of emergency egress light fixture 1550 in accordance with certain example embodiments. Specifically, FIG. 15 shows a side view of a lighting system 1500 that includes a light fixture 1550 covered by an example cover 1520. FIG. 16 shows a front view of a lighting system 1600 that includes the light fixture 1550 covered by another example cover 1620. FIG. 17 shows a front view of a lighting system 1700 that includes the light fixture 1550 covered by still another example cover 1720. FIG. 18 shows a front view of a lighting system 1800 that includes the light fixture 1550 covered by yet another example cover 1820.

The housing (hidden from view) of the light fixture 1550 covered in FIGS. 15-18 is more streamlined relative to the housing 102 of the light fixture 150 of FIG. 1. Further, the housing of the light fixture (and also the corresponding covers shown in FIGS. 15-19) are substantially circular in shape when viewed from the front. In addition, the light fixture 1550 of FIGS. 15-18 has multiple (in this case, three) light sources 1504 that are spaced (in this case, equidistantly) around the outer perimeter of the housing 1502.

The cover 1520 of FIG. 15 includes an aperture 1539 in an outer surface 1522 that allows a sensor 1503 in the side of the light fixture 1550 to be accessible. Further, because of the cylindrical shape of the cover 1520 of FIG. 15, the cover 1520 has a single outer surface 1522 and four planar top surfaces. The cover 1520 does not have any light source features, and the cover 1520 does not cover the light sources 1504 of the light fixture 1550. In this case, the front surfaces 1524 and the side surface 1522 of the cover 1520 make direct contact with the light fixture 1550.

While the cover 1620 of FIG. 16 does not include an aperture that traverses therethrough, the cover 1620 of FIG. 16 is otherwise substantially identical to the cover 1520 of FIG. 15. For example, the cover 1620 has a single outer surface 1622 and four planar top surfaces that intersect at junctions 1629. The cover 1620 does not have any light source features, and the cover 1620 does not cover the light sources 1504 of the light fixture 1650. In this case, the front surfaces 1624 and the side surface 1622 of the cover 1620 make direct contact with the light fixture 1550.

The cover 1720 of FIG. 17 has a single outer surface 1722 and three planar top surfaces that intersect to form three light source features 1725, one for each light source 1504. Each light source feature 1725 includes a curved outward protrusion 1733 having apex 1726, and in this example each light source feature 1725 covers at least part of the light source 1504 and a bottom wall of the light fixture 1550. In this case, the front surfaces 1724 and the side surface 1722 of the cover 1720 can, at least to some extent, make direct contact with the light fixture 1750.

The cover 1820 of FIG. 18 has a single outer surface 1822 and three planar top surfaces that intersect to form three light source features 1825, one for each light source 1504. Each light source feature 1825 includes a curved outward protrusion 1833 having apex 1826, and in this example each light source feature 1825 covers at least part of the light source 1504 and a bottom wall of the light fixture 1550. In this case, the front surfaces 1824 and the side surface 1822 of the cover 1820 can, at least to some extent, make direct contact with the light fixture 1850.

Figure 19:
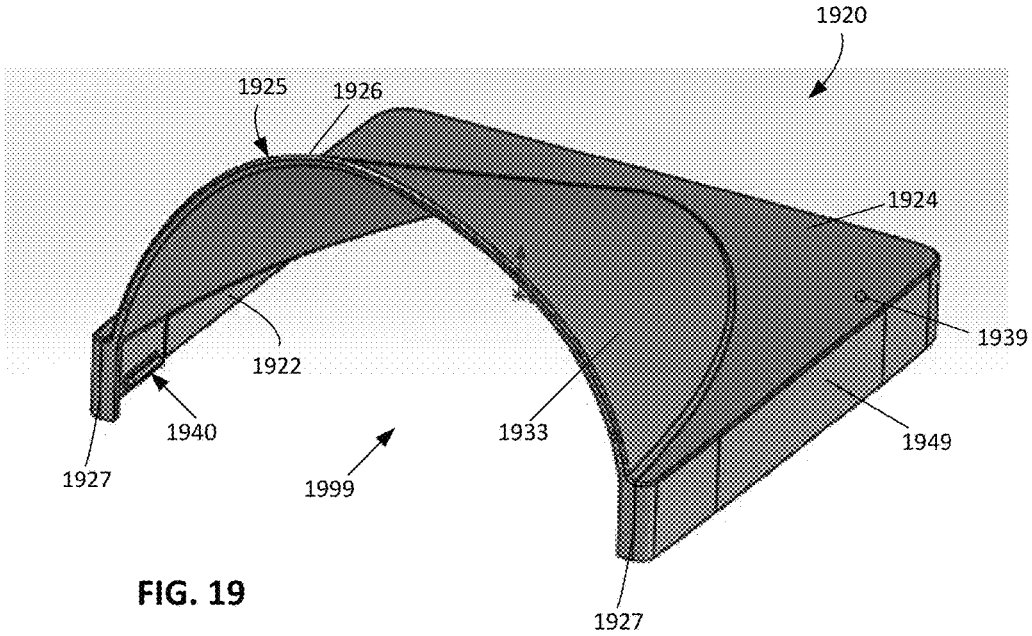
FIG. 19 shows another cover for a light fixture in accordance with certain example embodiments.
Figure 20A:
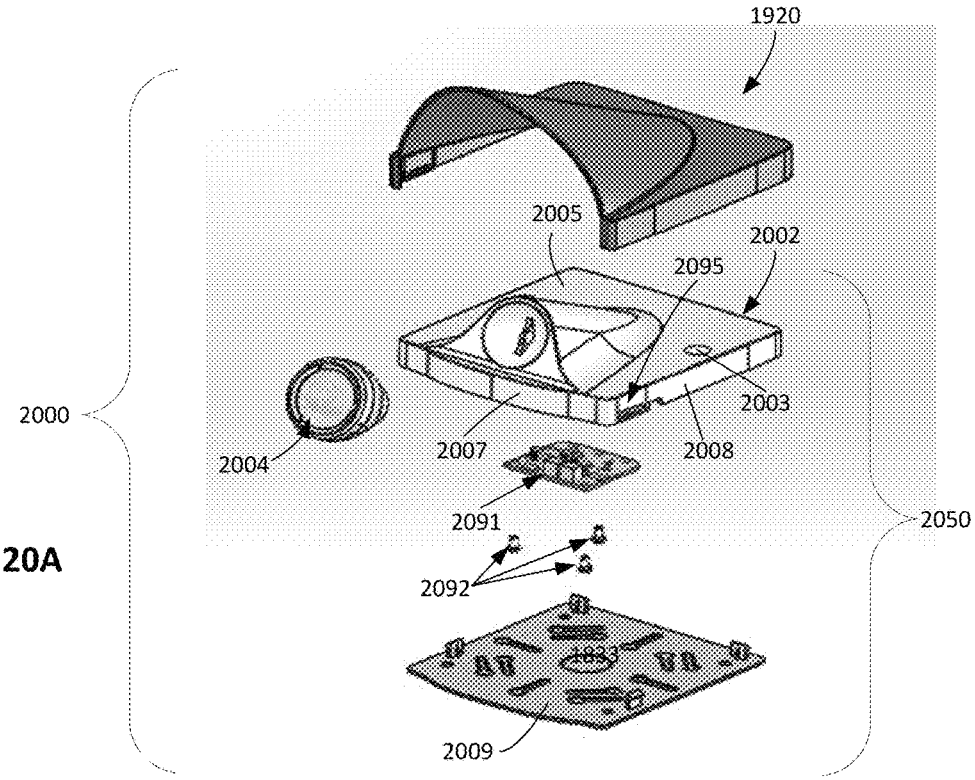

FIG. 19 shows a bottom-side perspective view of another cover 1920 for a light fixture in accordance with certain example embodiments. FIGS. 20A and 20B show an exploded view and a bottom-side perspective view, respectively, of a lighting system 2000 that includes the cover 1920 of FIG. 19 and a light fixture 2050 in accordance with certain example embodiments. The cover 1920 of FIGS. 19-20B is substantially the same as the cover 1020 of FIGS. 10A and 10B. Specifically, the cover 1920 can have a light source feature 1925 that includes one large protrusion 1933 that provides enough space to cover one (as in the case of the light fixture 2050 of FIGS. 20A and 20B) or multiple (as in the case of the light fixture 2150 of FIGS. 21A and 21B) light sources 2004. In this case, the light source feature 1925 completely covers the light source 2004 of the light fixture 2050 when viewed from the front.

The example cover 1920 of FIG. 19 includes two coupling features 1940 that are tabs that extend inward (toward the cavity 1999 formed by the front surface 1924, the light source feature 1925, the left side 1922, the right side 1949, the top side, and the bottom side 1927. Specifically, one coupling feature 1940 is disposed along the bottom of the left side 1922 adjacent to the bottom side 1927, and the other coupling feature 1940 (hidden from view in FIGS. 19 and 20A) is disposed along the bottom of the right side 1949 adjacent to the bottom side 1927.

In some cases, a light fixture (e.g., light fixture 2050) to which an example cover (e.g., cover 1920) is coupled can include one or more of a number of coupling features to help secure the cover to the light fixture. For example, as shown in FIG. 20A, the light fixture 2050 includes two coupling features 2095 that have one or more characteristics (e.g., location, shape, size, configuration) that complement the coupling features 1940 of the cover 1920. In this case, to complement the coupling features 1940 of the cover 1920 in the form of tabs, coupling features 2095 of the light fixture 2050 can be recesses of the same shape and a slightly larger size than the shape and size of the coupling features 1940. Further, the coupling features 2095 can be disposed at the bottom of the side surfaces 2008 of the light fixture 2050 adjacent to the bottom surface 2007 of the light fixture 2050.

The cover 1920 of FIGS. 19-20B also includes an aperture 1939 in the front surface 1924 of the cover 1920 that aligns with the position of an ancillary component 2003 of the light fixture 2050. FIG. 20A shows some of the components of the light fixture 2050, including the housing 2002, the light source 2004, a circuit board 2091, and the back surface 2009, which can be removable from the housing 2002 to allow access to one or more components (e.g., the circuit board 2091) within the housing 2002 of the light fixture 2050.

As discussed above, the light source feature 1925 of the cover 1920 is large enough to accommodate a light fixture with multiple light sources. For example, the cover 1920 of FIG. 19 is used in FIGS. 21A and 21B to cover a light fixture 2150 with two light sources 2104. Specifically, FIG. 21A shows a perspective view of a light fixture assembly 2101 that includes the lighting system 2100, and FIG. 21B shows a perspective view of the lighting system 2100. The lighting system 2100 of FIGS. 21A and 21B is substantially the same as the lighting system 2000 of FIGS. 20A and 20B, except as described below.

Referring to FIGS. 1-21B, the light fixture assembly 2101 of FIG. 21A shows the lighting system 2100 mounted to a junction box 2188. In such a case, the junction box 2188 can serve as the back surface of the housing of the light fixture 2050. In some cases, the housing of the light fixture can be coupled to the junction box 2188, and the cover 1920 can also be coupled to the junction box 2188. Attached to the junction box 2188 in FIG. 21A are a pair of hangar bar assemblies 2189, which are used to mount the lighting system 2100 and the junction box 2188 to a structure (e.g., studs).

The cavity formed by the light source feature 1925 is large enough to accommodate the two light sources 2104 of the light fixture 2150 without making physical contact with the light sources 2104. In other words, the light source feature 1925 is configured to obstruct a view of at least one light source 2104 of the light fixture 2150 from a user positioned at certain locations (e.g., directly in front) relative to the lighting assembly 2100 without obstructing light emitted by the at least one light source 2104.

Figure 22:
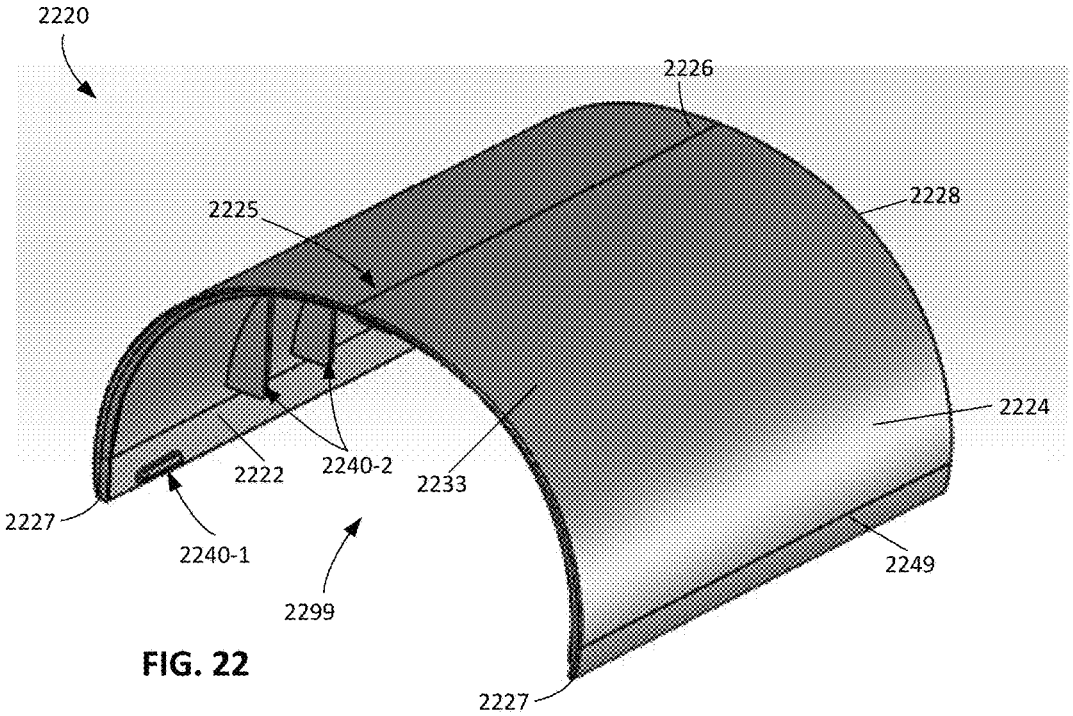
FIG. 22 shows yet another cover for a light fixture in accordance with certain example embodiments.
Figure 23:
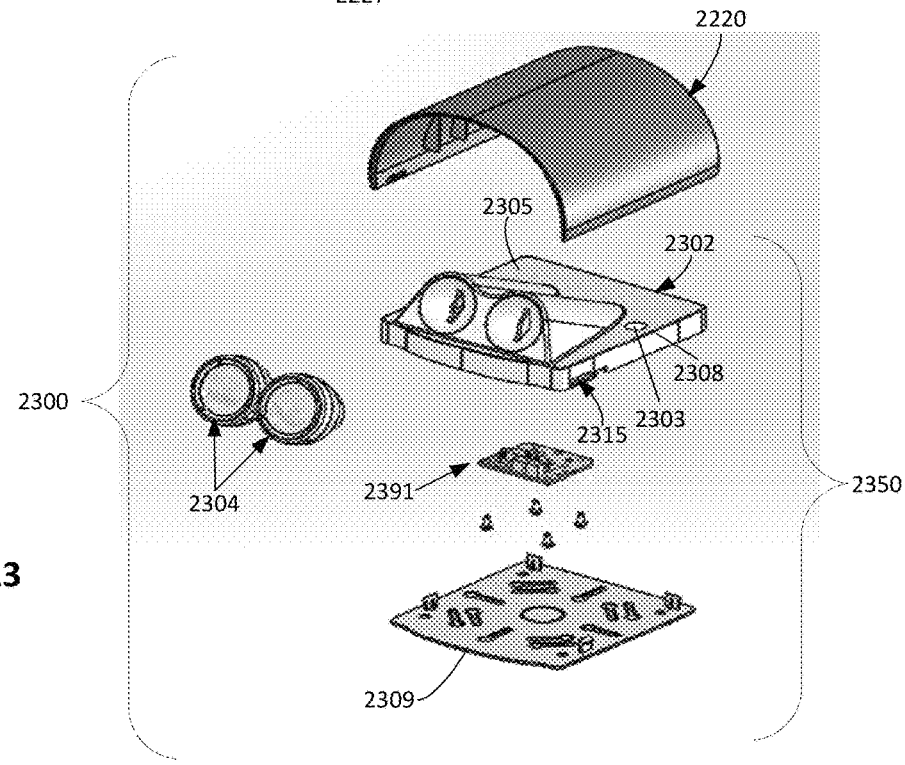
FIG. 23 shows the cover of FIG. 22 and the light fixture of FIGS. 21A and 21B in accordance with certain example embodiments.

FIG. 22 shows yet another cover 2220 for a light fixture in accordance with certain example embodiments. FIG. 23 shows an exploded view of a lighting system 2300 that includes the cover 2220 of FIG. 22 and a light fixture 2350 in accordance with certain example embodiments. The light fixture 2350 of the lighting system 2300 of FIG. 23 is substantially the same as the light fixture 2050 of FIG. 20A. For example, the light fixture 2350 of FIG. 23 shows the housing 2302, a circuit board 2391, and the back surface 2309, which can be removable from the housing 2002 to allow access to one or more components (e.g., the circuit board 2091) within the housing 2302 of the light fixture 2350. In this case, however, the light fixture 2350 has two light sources 2304 instead of just one.

The cover 2220 of FIGS. 22 and 23 is substantially the same as the cover 1320 of FIG. 13 and the cover 1420 of FIG. 14, except as described below. For example, the cover 2220 can have a semi-elliptical shape when viewed from above. In this way, the shape of the front surface 2224 preclude the need for a specific light source feature 2225. Put another way, the front surface 2224 and the light source feature 2225 are the same for cover 2220. The shape of the front surface 2224 creates a cavity 2299 that is large enough to cover one or multiple (as in the case of the light fixture 2350 of FIG. 23) light sources 2304.

Referring to FIGS. 1-23, as with the cover 1920 of FIG. 19, the example cover 2220 of FIGS. 22 and 23 includes two coupling features 2240-1 that are tabs that extend inward (toward the cavity 2299 formed by the front surface 2224, the left side 2222, the right side 2249, the top side 2228, and the bottom side 2227. Specifically, one coupling feature 2240-1 is disposed along the bottom of the left side 2222 adjacent to the bottom side 2227, and the other coupling feature 2240-1 (hidden from view in FIGS. 22 and 23) is disposed along the bottom of the right side 2249 adjacent to the bottom side 2227.

As with light fixture 2050 of FIG. 20A, light fixture 2350 of FIG. 23 can include one or more of a number of coupling features to help secure the cover to the light fixture. For example, as shown in FIG. 23, the light fixture 2350 includes two coupling features 2315 that have one or more characteristics (e.g., location, shape, size, configuration) that complement the coupling features 2240 of the cover 2220. In this case, to complement the coupling features 2240-1 of the cover 2220 in the form of tabs, coupling features 2315 of the light fixture 2350 can be recesses of the same shape and a slightly larger size than the shape and size of the coupling features 2240-1. Further, the coupling features 2315 can be disposed at the bottom of the side surfaces 2308 of the light fixture 2350 adjacent to the bottom surface 2307 of the light fixture 2350.

The example cover 2220 of FIG. 22 also includes a number (e.g., four) of coupling features 2240-2 that are configured differently than the tabs of coupling features 2240-1. Specifically, coupling features 2240-2 in this case are protruding elements disposed on an inner surface of the body 2224 and extending inward toward the cavity 2299. These protruding elements can be shaped and positioned to abut against an outer surface (in this case, the front surface 2305) of the housing 2302 of the light fixture 2350 when coupling features 2240-2 are engaged. In this way, coupling features 2240-2 can provide stiffening reinforcement for the cover 2220 when the cover 2220 covers the light fixture 2350.

In this example, there are two visible coupling features 2240-2 disposed adjacent to the left surface 2222 in parallel with the bottom surface 2227. While hidden from view in this example, there may be one or more additional coupling features 2240-2 aligned in series with the visible coupling features 2240-2 disposed toward the top surface 2228 of the cover 2220. Similarly, while hidden from view in this case, there can be one or more coupling features (similar to coupling features 2240-2) disposed on the opposite side of the inner surface of the body 2224, adjacent to the right surface 2249.

The housing 2302 of the light fixture 2350 can include one or more coupling features that complement one or more of the coupling features (e.g., coupling features 2240-1, coupling features 2240-2) of the cover 2220. For example, the front surface 2305 of the housing 2302 can have one or more coupling features 2315 in the form of detents etched or stamped into the front surface 2305. Such detents can be slightly larger than the bottom edge of the coupling features 2240-1 and can be positioned on the side surfaces 2308 in such a way that the bottom edge of the coupling features 2240-1 are disposed within the detents when the cover 2220 is coupled to the housing 2302 of the light fixture 2350.

In addition, in this case, the cover 2220 does not include an aperture for an ancillary component of the light fixture 2350. This omission may be because the light fixture 2350 does not have an ancillary component. Alternatively, as in this case, the light fixture 2350 does have an ancillary component 2303, but there is enough space in the cavity 2299 formed between the cover 2220 and the top surface 2305 of the light fixture 2350 to allow the ancillary component 2303 to operate without the need for an aperture in the cover 2220.

In certain example embodiments, while hidden from view in this case, the top surface 2228 can fully or partially enclose the cavity 2299 formed under the cover 2220. For example, the top surface 2228 of the cover 2220 can be a solid semi-elliptical surface that fully encloses the top end of the cavity 2299 when the cover rests against a flat surface (e.g., a structure such as a wall). Such a configuration of the top surface 2228 of the cover 2220 can help prevent external elements (e.g., dust, water, external light) from entering the cavity 2299, thereby protecting the light fixture 2350 disposed within the cavity 2299. Similarly, any of the example covers shown herein, or any other example covers described herein, can have such a top surface.

FIGS. 24A-24D show another light fixture assembly 2400 in accordance with certain example embodiments. FIG. 25 shows the cover 2420 of FIGS. 24A-24D in accordance with certain example embodiments. The light fixture 2450 of FIGS. 24A-24D can be substantially the same as the light fixtures of FIGS. 21B and 23 above. For example, the light fixture 2450 of FIGS. 24A-24D includes two light sources 2404.

Figure 24B:
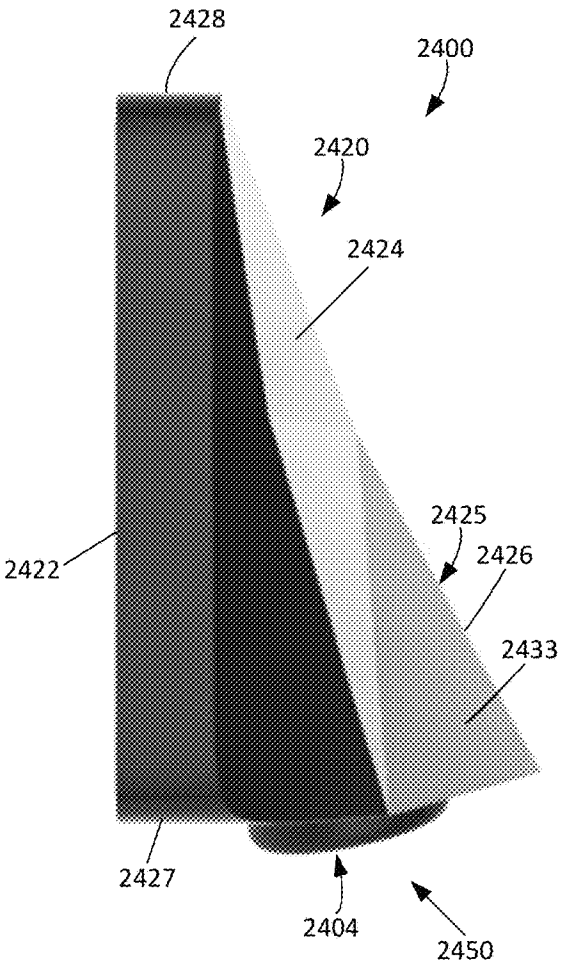
FIGS. 24A-24D show a cover for another light fixture in accordance with certain example embodiments.
Figure 24A:
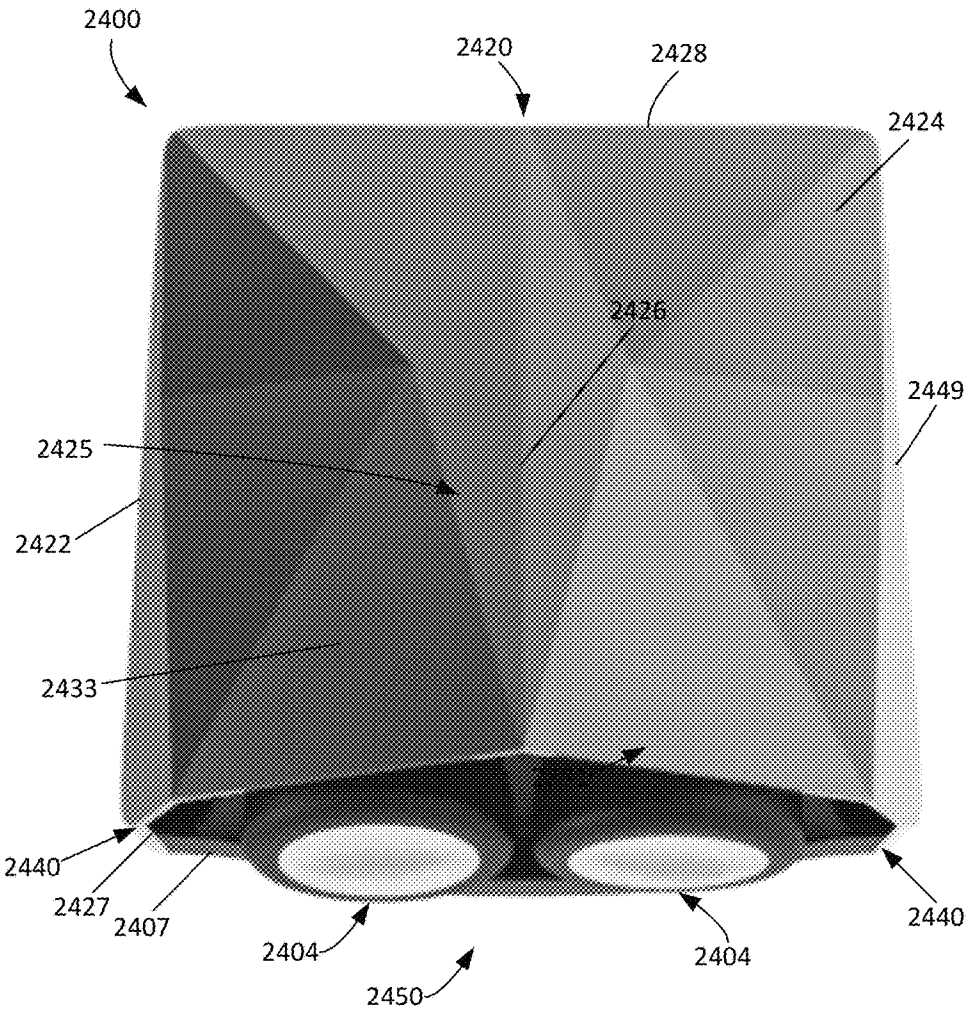
Figure 25:
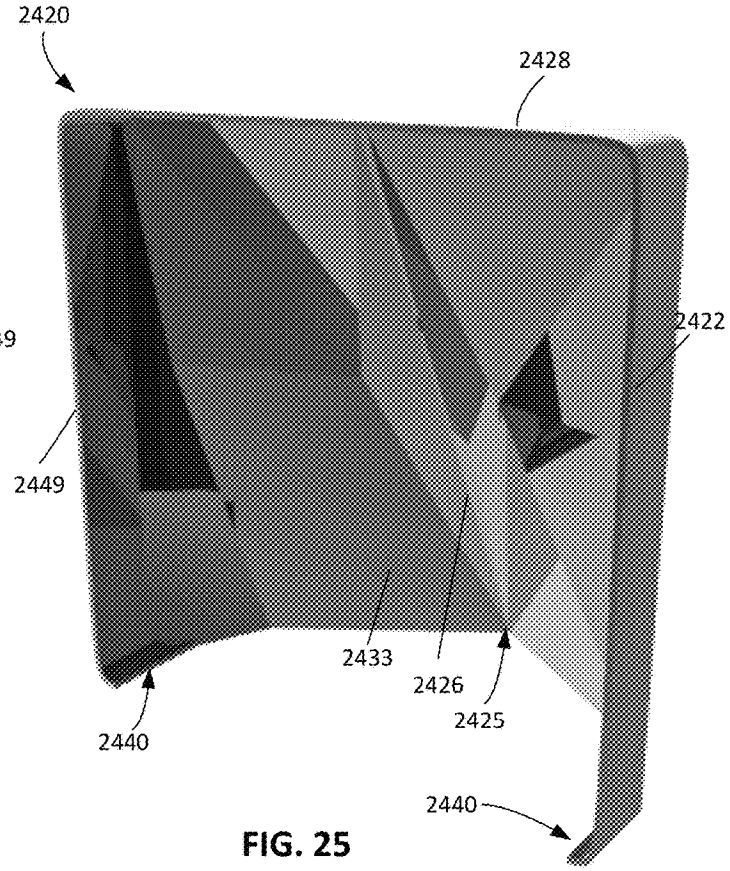
FIG. 25 shows the cover of FIG. 24 in accordance with certain example embodiments.
Figure 24C:
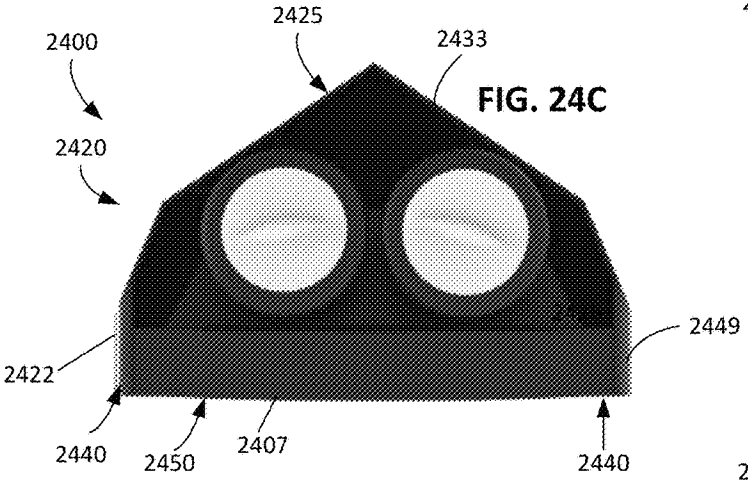
Figure 24D:
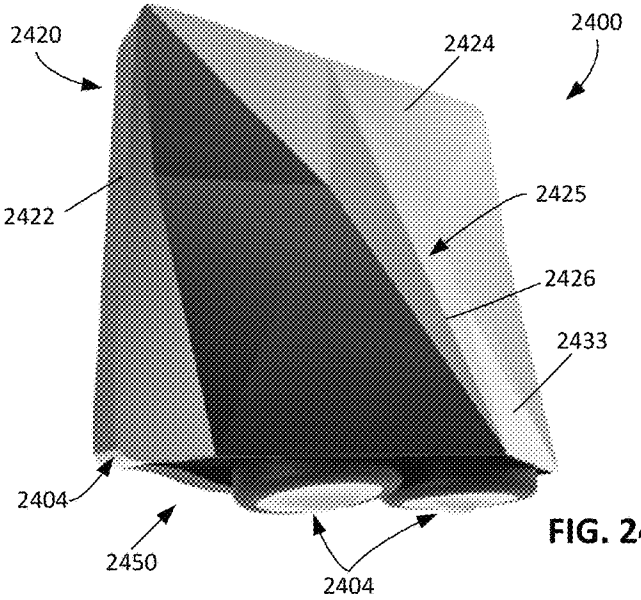

The cover 2420 of FIGS. 24A-25 is somewhat similar to the cover 720 of FIG. 7 above. For example, the protrusion 2433 (as well as the rest of the front surface 2424) can be multiple planar segments. In this case, the cover 2420 has a left surface 2422, a top surface 2428, a right surface 2449, and a bottom surface 2427. Incorporated with the front surface 2424, which is made up of a number of planar segments, is a light source feature 2425, which includes a number of protrusions 2433 having the planar segment configuration. The apex 2426 of the light source feature 2425 forms a junction between two adjacent planar segments of the protrusions 2433.

The cover also includes two coupling features 2440. Each coupling feature 2440 in this case is a type of tab that extends over a bottom corner of the light fixture 2450. One coupling feature 2440 is disposed along the bottom surface 2427 adjacent to the left surface 2422, and the other coupling feature 2440 is disposed along the bottom surface 2427 adjacent to the left surface 2449.

Example embodiments described herein allow an emergency egress light fixture to less obtrusive and more aesthetically pleasing appearance. Example embodiments can be customizable with respect to colors and/or patterns so that an example cover can blend into a particular environment in which a light fixture is located. Further, the shape, size, and dimensions of an example cover can be specifically configured for a particular light fixture and/or location of a particular light fixture. Example embodiments can be mass produced or made as a custom order.

Example covers can accommodate one or more ancillary features of a light fixture, including but not limited to light sources, sensors, indicating lights, cameras, and antennas. Example covers can be installed and/or removed by a user in the field without the use of tools. The example covers described herein can be installed and/or removed with respect to a new light fixture or an existing light fixture. Example embodiments can also be used in environments that require compliance with one or more standards and/or regulations.

Accordingly, many modifications and other embodiments set forth herein will come to mind to one skilled in the art to which example covers for emergency egress light fixtures pertain having the benefit of the teachings presented in the foregoing descriptions and the associated drawings. Therefore, it is to be understood that example covers for emergency egress light fixtures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A lighting system, comprising:

a light fixture comprising a body and at least one light source, wherein the light fixture is configured to couple to a structure, and wherein the body of the light fixture is enclosed; and a cover comprising at least one first fixture coupling feature and a light source feature, wherein the at least one first fixture coupling feature detachably couples to the body of the light fixture, wherein the cover physically covers at least a first portion of the body of the light fixture without obstructing light emitted by the at least one light source of the light fixture, and wherein the light source feature obstructs a view, when in use, of at least a second portion of the at least one light source without obstructing light emitted by the at least one light source.

2. The lighting system of claim 1, wherein the cover further covers, without physically contacting, at least a second portion of the body of the light fixture.

3. The lighting system of claim 2, wherein the second portion of the body of the light fixture comprises at least an upper portion of the at least one light source of the light fixture, wherein the at least one light source extends outward and downward from the body of the light fixture.

4. The lighting system of claim 1, wherein the body of the light fixture comprises at least one first cover coupling feature, wherein the at least one first cover coupling feature couples to the at least one first fixture coupling feature.

5. The lighting system of claim 1, wherein the light fixture is an emergency egress light fixture.

6. The lighting system of claim 1, wherein the structure comprises a wall.

7. The lighting system of claim 1, wherein the cover is further configured to couple to the structure.

8. The lighting system of claim 1, wherein the cover comprises a front surface, where the front surface has a color and a pattern that substantially matches a structure color and a structure pattern of the structure.

9. The lighting system of claim 1, wherein the light source feature extends outward from a remainder of the cover and allows movement of the at least one light source relative to the body of the light fixture.

10. The lighting system of claim 1, wherein the cover comprises an outer surface that is customizable by a user.

11. The lighting system of claim 10, wherein the outer surface of the cover comprises at least one characteristic that comprises at least one of a group consisting of a shape, a size, a color, and a pattern.

12. The lighting system of claim 10, wherein the outer surface of the cover is configured to receive wallpaper.

13. The lighting system of claim 1, wherein the cover further comprises at least one second fixture coupling feature that at least abuts against an outer surface of the body of the light fixture.

14. The lighting system of claim 13, wherein the at least one second fixture coupling feature provides stiffening reinforcement for the cover.

15. The lighting system of claim 1, wherein the cover comprises at least one aperture that aligns with and allows access to at least one ancillary component mounted on the body of the light fixture.

16. A cover for a light fixture, comprising:

a cover body; and at least one coupling feature disposed on the cover body, wherein the at least one coupling feature is configured to detachably couple to a body of an enclosed housing of the light fixture, wherein the cover body is configured to cover a substantial portion of an outer surface of the body of the enclosed housing of the light fixture without obstructing light emitted by at least one light source of the light fixture when the at least one coupling feature is coupled to the housing of the light fixture, wherein the cover body further comprises a light source feature that protrudes outward from a front surface of a remainder of the cover body, wherein the light source feature is configured to match a protrusion of the at least one light source relative to the housing of the light fixture, wherein the light source feature is configured to obstruct a view, when in use, of the at least one light source of the light fixture.

17. The cover of claim 16, wherein the cover body is configured to make direct physical contact with a top surface, a left surface, a right surface, and a first portion of a front surface of the housing of the light fixture.

18. The cover of claim 17, wherein the cover body is further configured to hide the at least one light source from view when in use without making direct physical contact with the at least one light source of the light fixture.

19. A lighting system, comprising:

a light fixture comprising a body and at least one light source, wherein the light fixture is configured to couple to a structure, and wherein the body of the light fixture is enclosed; and a cover comprising at least one first fixture coupling feature, wherein the at least one first fixture coupling feature detachably couples to the body of the light fixture, wherein the cover physically covers at least a first portion of the body of the light fixture without obstructing light emitted by the at least one light source of the light fixture, and wherein the cover further comprises at least one second fixture coupling feature that at least abuts against an outer surface of the body of the light fixture.

* * * * *